US006082059A

United States Patent [19]

Loomans

[11] Patent Number: 6,082,059

[45] Date of Patent: Jul. 4, 2000

[54] POUR AND SET CONCRETE CONSTRUCTION SYSTEM

[76] Inventor: David C. Loomans, 7463 Brookhaven Dr., West Bend, Wis. 53095

[21] Appl. No.: 08/873,038

[22] Filed: Jun. 11, 1997

[51] Int. Cl.[7] ..... E04B 1/34

[52] U.S. Cl. ..... 52/143; 249/66

[58] Field of Search ..... 52/143; 249/26, 249/31, 66.1, 105, 108, 120, 122, 124, 139, 175–177, 178–180, 184–186

[56] References Cited

U.S. PATENT DOCUMENTS

| | | |
|---|---|---|
| 963,431 | 7/1910 | Gates . |
| 1,047,102 | 12/1912 | Meinken . |
| 1,141,193 | 6/1915 | McArthur . |
| 1,149,032 | 8/1915 | Cousins . |
| 1,201,439 | 10/1916 | Chance . |
| 1,389,803 | 9/1921 | Wolfe . |
| 1,400,682 | 12/1921 | Keogan . |
| 1,414,288 | 4/1922 | Knudson . |
| 1,477,065 | 12/1923 | Kuert . |
| 1,595,461 | 8/1926 | Franson . |
| 1,632,899 | 6/1927 | Hutchins . |
| 1,679,040 | 7/1928 | Lake . |
| 1,708,555 | 4/1929 | Smith . |
| 2,501,877 | 3/1950 | Rumble . |
| 2,593,465 | 4/1952 | Le Tourneau . |
| 2,966,714 | 1/1961 | Eways et al. . |
| 2,968,082 | 1/1961 | Schutz et al. . |
| 3,089,217 | 5/1963 | Filippi . |
| 3,148,429 | 9/1964 | Garmon . |
| 3,435,567 | 4/1969 | Tyson . |
| 3,548,467 | 12/1970 | Allred . |
| 3,555,751 | 1/1971 | Thorgusen . |
| 3,659,977 | 5/1972 | Haws . |
| 3,732,052 | 5/1973 | Gunia . |
| 3,790,321 | 2/1974 | Bunger . |
| 4,065,540 | 12/1977 | Okami . |
| 4,140,466 | 2/1979 | Snow et al. . |
| 4,219,978 | 9/1980 | Brown . |
| 4,330,970 | 5/1982 | Bonink . |
| 4,761,126 | 8/1988 | del Valle . |
| 5,103,604 | 4/1992 | Teron . |
| 5,246,640 | 9/1993 | Bryant . |
| 5,335,472 | 8/1994 | Phillips . |
| 5,520,531 | 5/1996 | Del Monte . |
| 5,566,520 | 10/1996 | Branitzky . |

*Primary Examiner*—Beth A. Stephan
*Attorney, Agent, or Firm*—Andrus, Sceales, Starke & Sawall

[57] ABSTRACT

A building construction system for forming reinforced concrete building components on-site includes a form assembly with movable side form components which can be moved between an open position and a closed position. A bottom forming arrangement is placed between the side form members, and cooperates with the side form members to define a form cavity when the side form members are closed. The form assembly is preferably mounted to a mobile frame and can be moved to various positions on the construction site. Core form assemblies are engageable with the bottom forming arrangement for forming cores in concrete components when concrete material is placed between the side form members. Each core form assembly includes peripheral outer wall structure which is movable between a forming position to form the core, and a collapsed position in which the wall structure is moved away from the surfaces of the concrete material defining the core. Reinforcement is also engaged with the bottom forming member.

36 Claims, 18 Drawing Sheets

FIG. 5
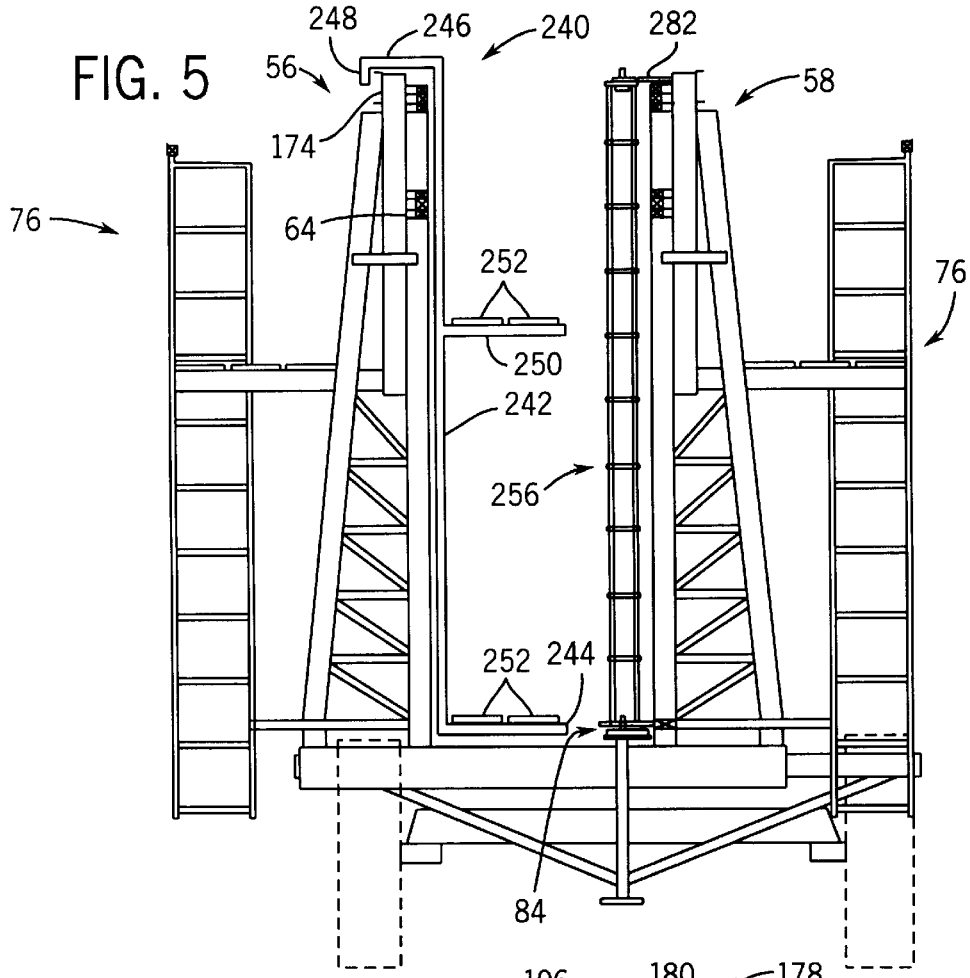
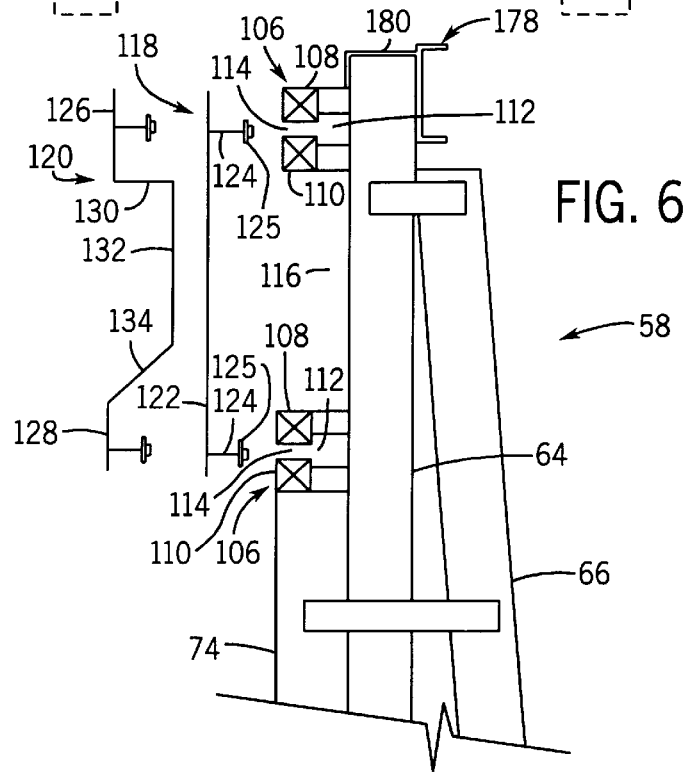
FIG. 6

262
264
319
286
286

264
262
264
262
284
284

316
312
310
312
314
256
258
258
260
260
286
256
286
256
284
284

304
264
308
278
264
278
262
309
40,42
288
276
274
304
272
278
304
304
266
266
306
308
264
266
288'
264

264
258
262
260
256

262
264

264
262
258
260
288
304
276
268
270
280
302
266
298
300
306
292
294
290

264
317
317
288
268
300
306
292
290

264
262
256

288
264
304
268
266
262
288'

288
290

406
420
390
404
408
384
412
418
378
416
358
358
410
386
386
23
23
400
398
398
402
402
388
104
400
398
398
402
402
392
356
356
396
364
100
360
90
362
394
84
92
320
320
88
88
92
94
94
86
98
96
86
50
98

FIG. 29
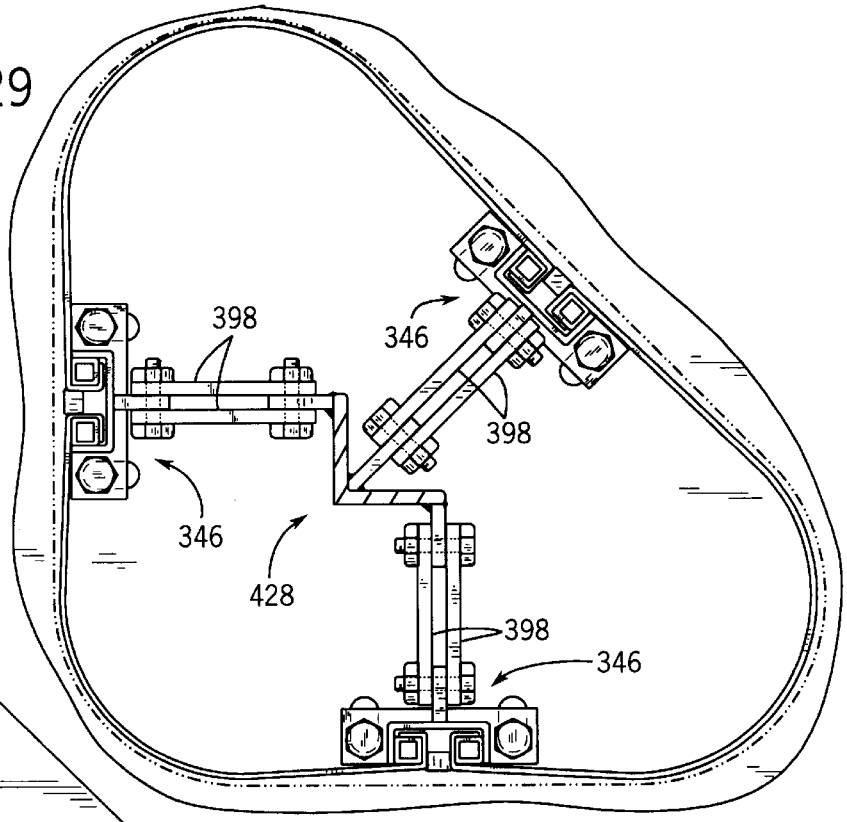
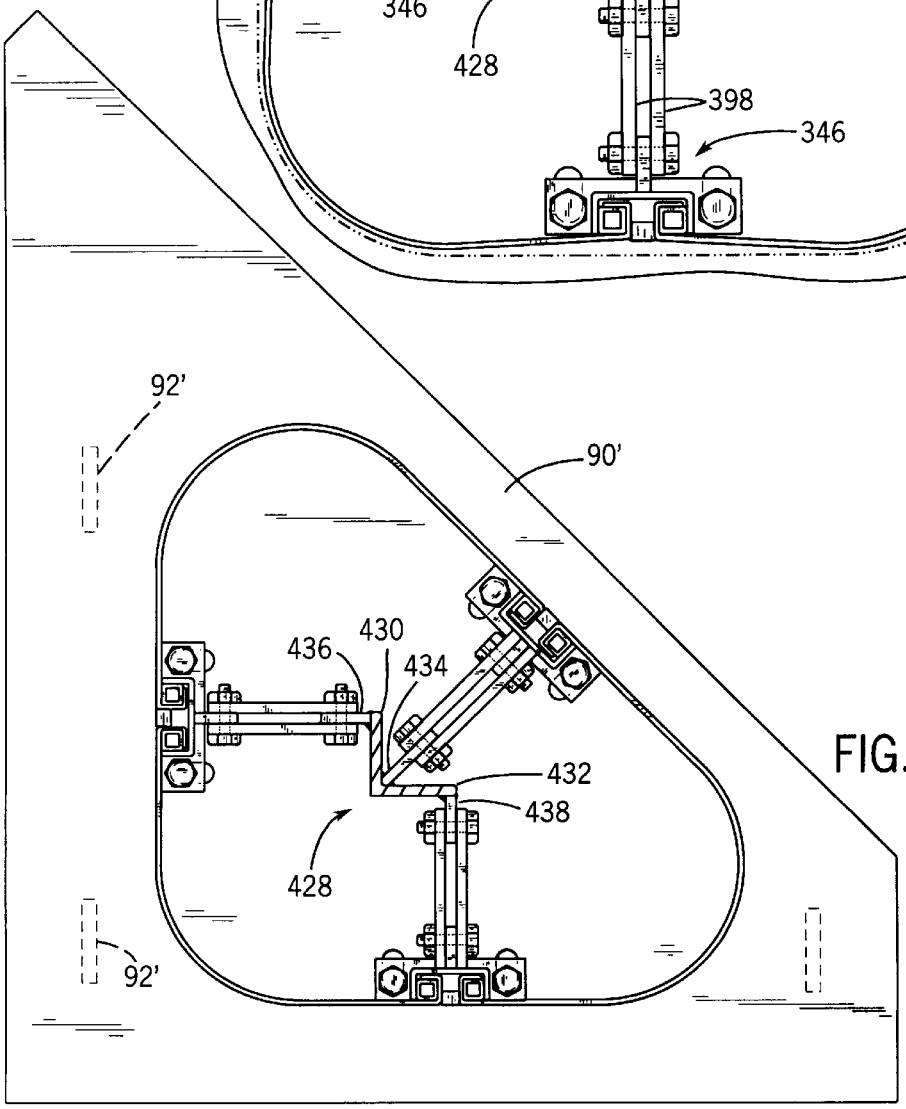
FIG. 28

POUR AND SET CONCRETE CONSTRUCTION SYSTEM

BACKGROUND AND SUMMARY OF THE INVENTION

This invention relates to a system for producing precast concrete members, and more particularly relates to an on-site precast concrete construction system.

The cost of building construction has increasingly risen over the years. In many cases, less expensive building materials and reduction in labor costs have been used to contain the costs of building construction. However, these cost containment methods have resulted in production of buildings having relatively poor quality of overall construction and requiring relatively high maintenance. In particular, rising costs of building high quality, fire resistant concrete buildings have resulted in an increased number of less expensive wood frame buildings, for use in applications such as multi-family buildings, condominiums and commercial buildings.

It is an object of the present invention to provide a system for producing concrete buildings which enables efficient construction and erection of building components to contain building costs. It is a further object of the invention to provide such a building construction system which is adapted for use at the construction site to reduce costs and time of construction. Yet another object of the invention is to provide such a system which is flexible and modular so as to enable construction of various building components on-site with a relatively small work force. Further objects of the invention are to provide improvements in particular aspects of concrete component construction, such as forming of cores in concrete members, construction of reinforced concrete wall members, and various aspects of form assemblies for use in constructing concrete members.

In accordance with one aspect of the invention, a system for casting a concrete member includes a pair of spaced form members defining first and second spaced side form surfaces, with an end member defining an end form surface extending between the first and second spaced side form surfaces to define a form cavity. At least one core form assembly is mounted to the end member and is disposed between the side form surfaces. The core form assembly defines a core forming surface, and includes a collapsing arrangement for moving the core form assembly from a forming position in which the core forming surface functions to define a core in concrete material placed between the first and second side form surfaces, and a collapsed position in which the core form surface is moved away from the concrete material defining the core to enable the core form assembly to be withdrawn from the core. The core form assembly defines an upper end and a lower end, and the lower end of the core form assembly is mounted to the end member. The upper end of the core form assembly is mounted to a top member, and the core form assembly is preferably movably mounted to both the end member and the top member for movement between its forming position and its collapsed position. In a preferred form, at least one fastener extends between the core form assembly and each of the end member and the top member, and slot structure is formed in the end and top members. The fastener is movable within the slot structure for accommodating movement of the core form assembly between its forming position and its collapsed position.

The core form assembly further includes an actuator for providing movement of the core form assembly between its forming position and its collapsed position. The actuator is preferably interconnected with both the end member and the top member. The actuator includes a handle interconnected with a cam member operably engageable with the top member for moving the actuator between first and second positions. In its first position, the actuator maintains the core form assembly in its forming position, and in its second position the actuator functions to move the core form assembly to its collapsed position. The actuator is preferably in the form of an actuator rod extending into and through an axial passage defined by the core form assembly, and which is movable between the first and second positions in response to operation of the handle and the cam member. A spring is interconnected between the actuator rod and the end member for biasing the actuator rod toward its first position in which the core form assembly is in its forming position. The actuator handle and cam member are operable against the force of the spring for moving the actuator member from its first position to its second position. The actuator member is preferably in the form of a rod extending longitudinally within the axial passage defined by the core form assembly. The actuator rod is interconnected with the peripheral wall structure via at least one pair of opposed link members, each of which is pivotably mounted to the actuator rod and to the peripheral wall structure. The link members function to move the peripheral wall structure inwardly from its forming position to its collapsed position upon axial movement of the actuator rod from its first position to its second position.

The peripheral wall structure preferably defines a pair of spaced, facing end sections which define a space therebetween. A resilient filler is disposed within the space between the spaced, facing end sections. The resilient filler is compressed between the spaced, facing end sections as the peripheral wall structure is moved to its collapsed position from its forming position during movement of the actuator rod from its first position to its second position. Compression of the resilient filler enables the peripheral wall structure of the core form assembly to move inwardly away from the surfaces of the concrete material defining the core when the peripheral wall structure is moved inwardly by movement of the actuator rod through the link members.

The actuator rod, which functions to move the peripheral wall structure of the core form assembly between its forming position and its collapsed position, is preferably interconnected with the peripheral wall structure via a pair of retainers interconnected with the peripheral wall structure, with the pair of link members extending between the actuator rod and the retainers. In a preferred form, the spaced, facing end sections of the peripheral wall structure each define a channel, and each retainer includes a pair of spaced engagement members. Each engagement member is received within one of the end section channels, such that the engagement members function to tie the spaced, facing end sections of the peripheral wall structure together. Each channel includes an inwardly extending lip, so that the spaced, facing end sections define a pair of lips which are spaced apart from each other. The resilient filler is preferably interposed between the lips and occupies the space therebetween, and is preferably in the form of caulk material placed between the lips. The engagement members of each retainer are interconnected with each other through any satisfactory structure, such as a retainer bar, and each link is pivotably interconnected with the retainer bar. With this construction, movement of the actuator rod from its first position to its second position is transferred through the links to the retainers, to draw the retainers inwardly toward each other. This movement of the retainers functions to draw the peripheral wall structure inwardly at the spaced, facing end sections through the retainers, which movement is enabled by compression of the resilient filler between the spaced, facing end sections. Once the peripheral wall structure is moved to its collapsed position in this manner, the core form assembly can be withdrawn from the core.

In accordance with another aspect of the invention, a reinforced concrete wall structure is made up of first and second spaced columnar reinforcement structures. Each of the first and second spaced columnar reinforcement structures includes an upper attachment member and a lower mounting member, and transverse reinforcement structure extends between and is interconnected with the first and second spaced columnar reinforcement structures. Concrete material is placed about the first and second spaced columnar reinforcement structures and the transverse reinforcement structure. The concrete material is placed so as to define an upper surface configured such that the upper attachment member of each of the first and second spaced columnar reinforcement structures is exposed, and a lower surface configured such that the lower mounting member of each of the first and second columnar reinforcement structures is exposed. With this construction, each lower mounting member of the spaced columnar reinforcement structures forming a part of an upper reinforced concrete wall section can be placed over the upper attachment member of a columnar reinforcement structure forming a part of a lower reinforced concrete wall section, and the lower mounting member and the upper attachment member are secured together to mount the upper wall section to the lower wall section. Further, the upper attachment members are utilized to remove the reinforced concrete wall structure from a form assembly, which enables the reinforced concrete wall section to be removed before the concrete is fully cured in order to reduce cycle time for producing subsequent reinforced concrete wall structures.

In a preferred form, each upper attachment member is in the form of an upper plate member and each lower mounting member is in the form of a lower plate member. The columnar reinforcement structure includes a series of vertical reinforcing members extending between and mounted to the upper and lower plate members. Each upper attachment member is in the form of an upstanding fastener mounted to the upper plate member and extending upwardly from the upper surface of the wall section. Each lower mounting member preferably includes cavity structure defining an outwardly-opening recess in the concrete material above the lower plate member. The lower plate member preferably includes an opening in communication with the recess, and the recess opens onto a side surface of the concrete wall section. With this construction, the upstanding fastener making up the upper attachment member of a lower reinforced concrete wall section can be inserted through the opening in the lower plate member of an upper concrete wall section and received within the recess disposed above the lower plate member. The upstanding member may be threaded and an engagement member, such as a nut, can be engaged with the threaded upstanding member for maintaining the upper reinforced concrete wall section in position relative to the lower reinforced concrete wall section. A shim member is preferably located between the upper plate member of the lower concrete wall structure and the lower plate member of the upper concrete wall structure. The upper plate member, the lower plate member and the shim member are preferably welded together to fixedly mount the upper reinforced concrete wall section to the lower reinforced concrete wall section. The shim member can vary in its thickness and cross section, to accommodate manufacturing variations and to ensure that the upper reinforced concrete wall structure is level.

The reinforced concrete wall structures are produced utilizing a pair of spaced form members defining spaced form surfaces, and the first and second spaced columnar reinforcement structures are placed between the spaced form surfaces. The transverse reinforcement structure is interconnected between the first and second spaced columnar reinforcement structures after placement between the form surfaces. As noted previously, the concrete material is placed so as to define an upper surface configured such that the upper attachment member of each columnar reinforcement structure is exposed, and a lower surface configured such that the lower mounting member of each columnar reinforcement structure is exposed. The reinforced wall structure is removed from between the spaced form members by attachment to the upper attachment members of the first and second spaced columnar reinforcement structures, and subsequently causing relative movement between the form members and the reinforced wall structure. One or more core form assemblies, having a construction as described above, may be placed between the form surfaces to form cores in the reinforced wall structure between the first and second spaced columnar reinforcement structures. Each upper attachment member is in the form of an upstanding member which extends upwardly from an upper surface defined by the reinforced wall structure, and the step of attaching to the upper attachment member is carried out by engaging the upstanding member. The reinforced wall structure can then be removed from the form assembly by lifting the reinforced wall structure through the attachment members out of the cavity defined by the form assembly. Alternatively, either the form assembly itself or the form members can be removed from the surfaces of the reinforced concrete wall structure.

In a preferred form, the first and second spaced columnar reinforcement structures are placed within a cavity defined by a form assembly so as to extend vertically within the cavity, and the first and second columnar reinforcement structures are then secured in predetermined positions relative to each other within the cavity. The horizontal reinforcing members are then secured to the first and second spaced columnar reinforcing structures so as to extend therebetween, and concrete material is then placed into the cavity to surround the first and second columnar reinforcement structures and the horizontal reinforcing members. In a preferred form, the form assembly includes a bottom forming member defining a upwardly facing forming surface. The step of securing the first and second columnar reinforcement structures within the cavity is carried out by mounting the lower mounting plate of each of the first and second columnar reinforcement structures to the bottom forming member. As noted previously, cavity structure is preferably mounted to each lower mounting plate, and one of a series of studs secured to the bottom forming member extends upwardly through the opening formed in the lower mounting plate into the cavity. The stud is preferably threaded, and a nut is engaged with the stud for securing each columnar reinforcement structure to the bottom forming member. After the reinforced wall structure has been constructed by placing concrete into the form cavity and allowing the concrete to at least partially cure, the side form members are removed so as to expose the cavity to enable the nut to be disengaged from the stud. The reinforced concrete wall structure can then be lifted off the bottom forming member and removed from the form cavity. The lower mounting plate of each columnar reinforcement structure thus provides the dual function of temporarily securing the columnar reinforcement structure in position on a bottom forming member of the form assembly, and mounting the reinforced concrete wall section to an attachment member such as the upper attachment plate of another reinforced concrete wall section in the manner as described previously for securing the wall section in position in a building.

In accordance with another aspect of the invention, a concrete form system includes at least one form member having a forming surface, and two or more form inserts adapted for mounting to the form member adjacent the forming surface. Each form insert defines a forming surface different from that of the other form inserts, to form a concrete member having varying surface configurations. The form system preferably includes a recess bordered by mounting structure, and each insert includes engagement structure engageable with the mounting structure for removably mounting the insert to the form system. The mounting structure defines a passage, and the engagement structure of each insert is preferably in the form of one or more retainer members which are slidably receivable within the passage for removably mounting the insert to the form system. Illustratively, one of the form inserts may include a substantially planar form surface which is coplanar with a planar portion of the forming surface adjacent the recess. A second one of the inserts may include an outwardly extending pocket which is received within the recess, for forming an outwardly extending protrusion in a concrete member.

In accordance with yet another aspect of the invention, a form assembly for forming a concrete member includes a form bed assembly and one or more bottom form members engageable with the form bed assembly, each of which defines an upwardly facing forming surface. First and second side form members define facing side form surfaces extending upwardly from the upwardly facing form surface defined by the one or more bottom form members. At least one of the side form members is movable from a closed position to an open position away from the form bed assembly and the other of the side form members, to provide access to the form bed assembly. In a preferred form, both the first and second side form members are movable toward and away from the form bed assembly and each other between open and closed positions. The side form members may be slidably mounted to rail structure fixed in a predetermined position relative to the form bed assembly, for movement between their open and closed positions. Each bottom form member defines a pair of side edges, and the side form surface of each of the first and second side form members is engageable with one of the bottom form member side edges when in their closed positions.

The first and second side form members each define an upper end, and rail structure is mounted to each of the first and second side form members toward the upper ends thereof. A hopper is adapted to receive a quantity of concrete material and includes a discharge for dispensing concrete material into the form cavity. The hopper includes roller structure engageable with the rail structure for providing movement of the hopper relative to the side form members. In a preferred form, different bottom form members can be utilized to construct concrete members having different widths. This functions to vary the spacing between the side form members when the side form members are engaged with the side edges of the bottom form members. The hopper includes a variable position arrangement for maintaining the hopper roller structure in engagement with the rail structure of the side form members when the side form members are spaced different distances from each other. The hopper preferably includes first and second hopper sections, each of which includes its own discharge. Each hopper section includes separate roller structure engageable with the rail structure of one of the first and second side form members. The variable position arrangement functions to vary the spacing between the first and second hopper sections to accommodate variations in spacing between the first and second side form members to maintain the roller structure of each hopper section in engagement with the rail structure of one of the side form members. The discharge of each hopper section is located toward the side form member to which the hopper section is mounted, and is preferably oriented so as to discharge concrete material between a core form assembly and the forming surface of the side form member to which the hopper section is mounted. The variable position connection arrangement between the pair of hopper sections includes a pair of overlapping structural connector numbers. Each structural connector member is mounted to one of the hopper sections, and releasable engagement members function to secure the structural connection members together in varying positions relative to each other, to vary the spacing between the first and second hopper sections.

As noted previously, the form assembly includes first and second side form members, at least one of which is movable to an open position relative to the other to provide access to a form cavity between the form members. A scaffold is removably engageable with the side form member when in its open position, and includes a platform for supporting a worker within the form cavity when the movable one of the side form members is in its open position. The side form member to which the scaffold is mounted defines an upper end, and the scaffold includes engagement structure which is engageable with the side form member upper end, and support structure depending from the engagement structure. The support structure is receivable within the form cavity, and the platform is mounted to the support structure. The engagement structure is preferably in the form of inverted hook-like structure engageable with the upper end of the side form member, and the support structure engages the forming surface of the side form member. The scaffold preferably includes a lower platform providing access to the form bed assembly and the bottom form member for enabling a worker to secure the columnar reinforcement structures to the bottom form member, and an upper platform spaced thereabove for providing access to the upper portions of the form cavity.

The form assembly is preferably mobile, and is mounted to a frame carrying ground-engaging wheels. The side form members are movably mounted to the frame for movement toward and away from each other, between a closed position and an open position. The form bed assembly is fixedly mounted to the frame between the side form members. The hopper is mounted to the frame for movement between a lowered position for receiving concrete material, and a raised position in which the discharge defined by the hopper is positioned so as to discharge the concrete material from the hopper into the form cavity. The hopper is preferably mounted to a carrier which functions to move the hopper between its raised and lowered positions, and the carrier preferably includes rail structure in alignment with rail members provided on the upper ends of the side form members for enabling the hopper to be moved onto the rail structure of the side form members when the hopper is moved to its raised position.

It is understood that the various aspects of the invention may be utilized separate and apart from each other.

However, the aspects of the invention are preferably utilized in combination to yield an on-site precast concrete construction system which provides efficient and low-cost manufacture of concrete components for constructing a building.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In drawings:

FIG. 5 is a partial section view similar to FIG. 2, showing side form members of the form assembly moved apart to provide access to a form cavity therebetween;

FIG. 6 is a partial section view showing an upper portion of one of the side form members of the form assembly of FIG. 2, illustrating the components of a removable form insert system for varying the configuration of a wall constructed utilizing the form assembly of FIG. 2;

FIG. 28 is a top view of one of the core form assemblies of FIG. 29, showing the core form assembly in is forming position;

FIG. 29 is a view similar to FIG. 28, showing the core form assembly in its collapsed position;

DETAILED DESCRIPTION OF THE INVENTION

Figure 1:
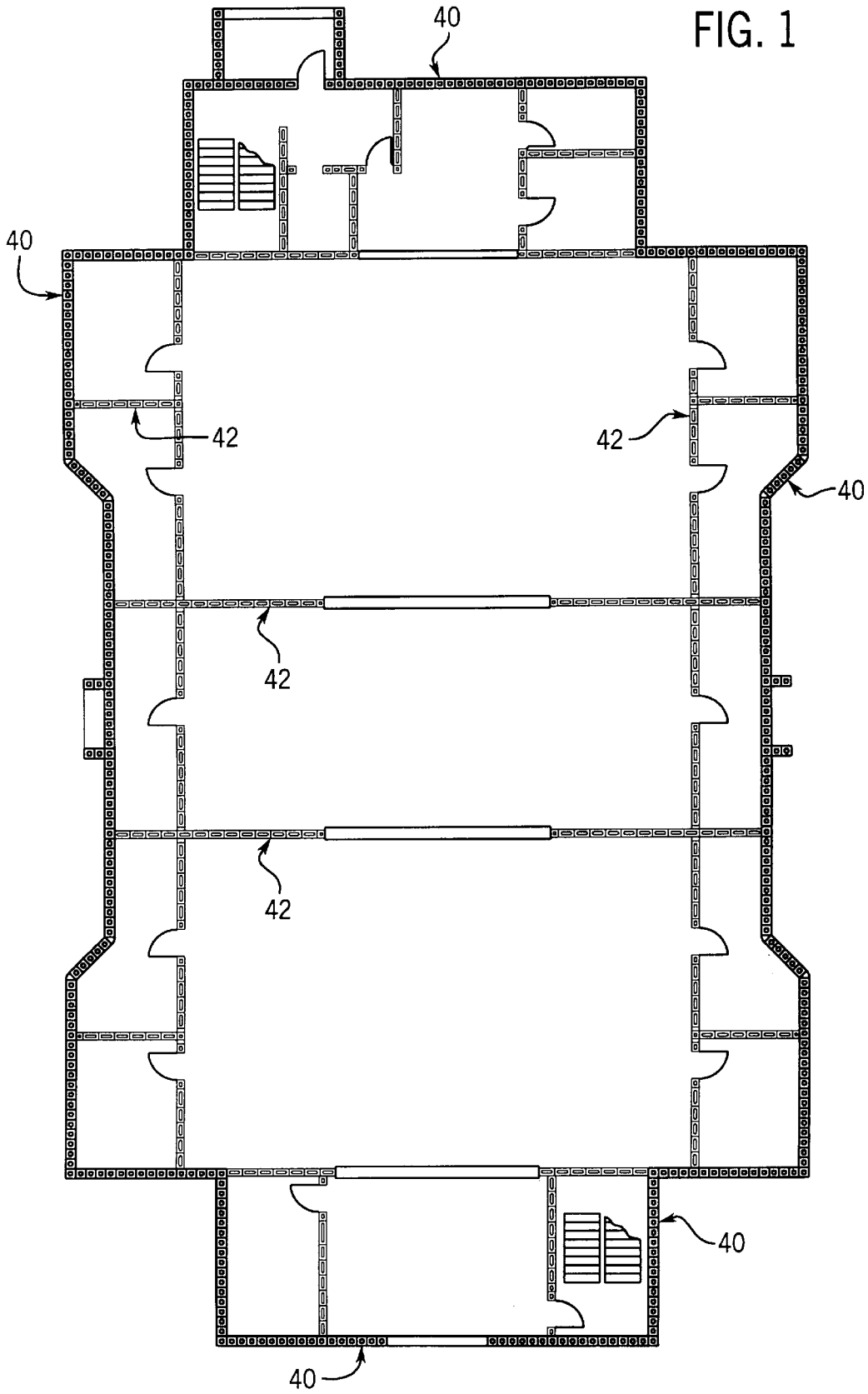
FIG. 1 is a plan view showing a representative floor plan for a concrete building constructed utilizing the pour and set building system of the invention.

FIG. 1 illustrates a representative floor plan for a building, the components of which are manufactured on-site using the pour and set construction system of the present invention. As shown in FIG. 1, the building includes a series of exterior wall sections 40 and interior wall sections 42. Exterior wall sections 40 and interior wall sections 42 are formed using an on-site reinforced concrete wall construction system to be described hereafter, as are the floor components, stairwell components and other concrete structures incorporated into the building. The following description and drawings representatively illustrate construction of wall components, although it should be understood that the other components of the building can be constructed using the pour and set construction system of the invention.

Briefly, each of wall sections 40 and 42 is in the form of a precast reinforced concrete wall section which is poured on-site in a form assembly to be described hereafter, and the wall section is then removed from the form assembly after an initial curing period and can be immediately placed in position, or it can be allowed to cure prior to placement. All wall sections for one floor of the building are allowed sufficient time for a final cure prior to placement of precast concrete floor planking on the wall sections 40 and 42 once mounted in position.

It should be understood that the floor plan illustrated in FIG. 1 is representative of a virtually endless number of floor plan configurations which can be constructed utilizing the pour and set building system of the invention.

Figure 2:
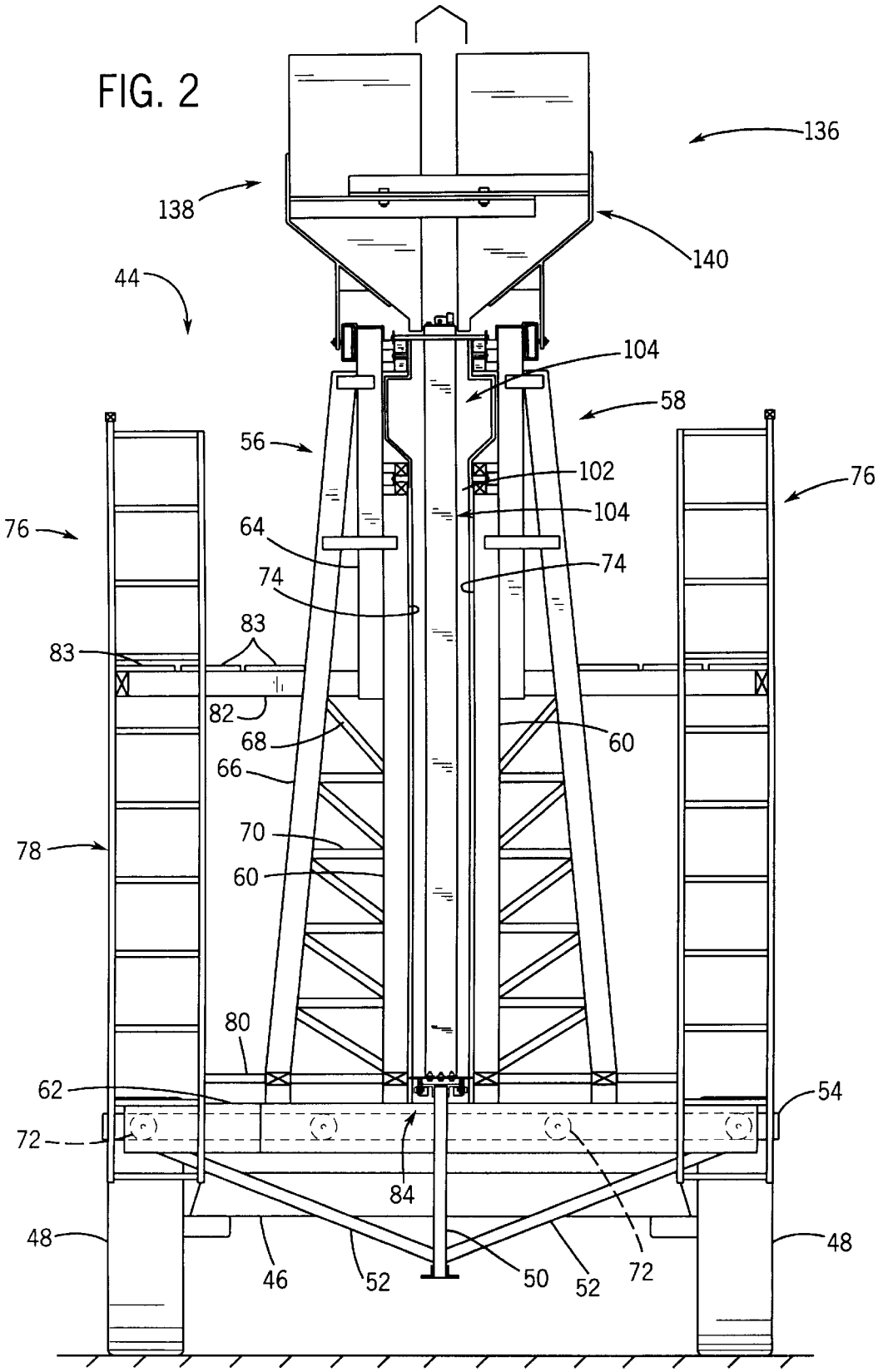
FIG. 2 is a partial section view of a mobile form assembly for use in constructing the components for the building of FIG. 1.
Figure 3:
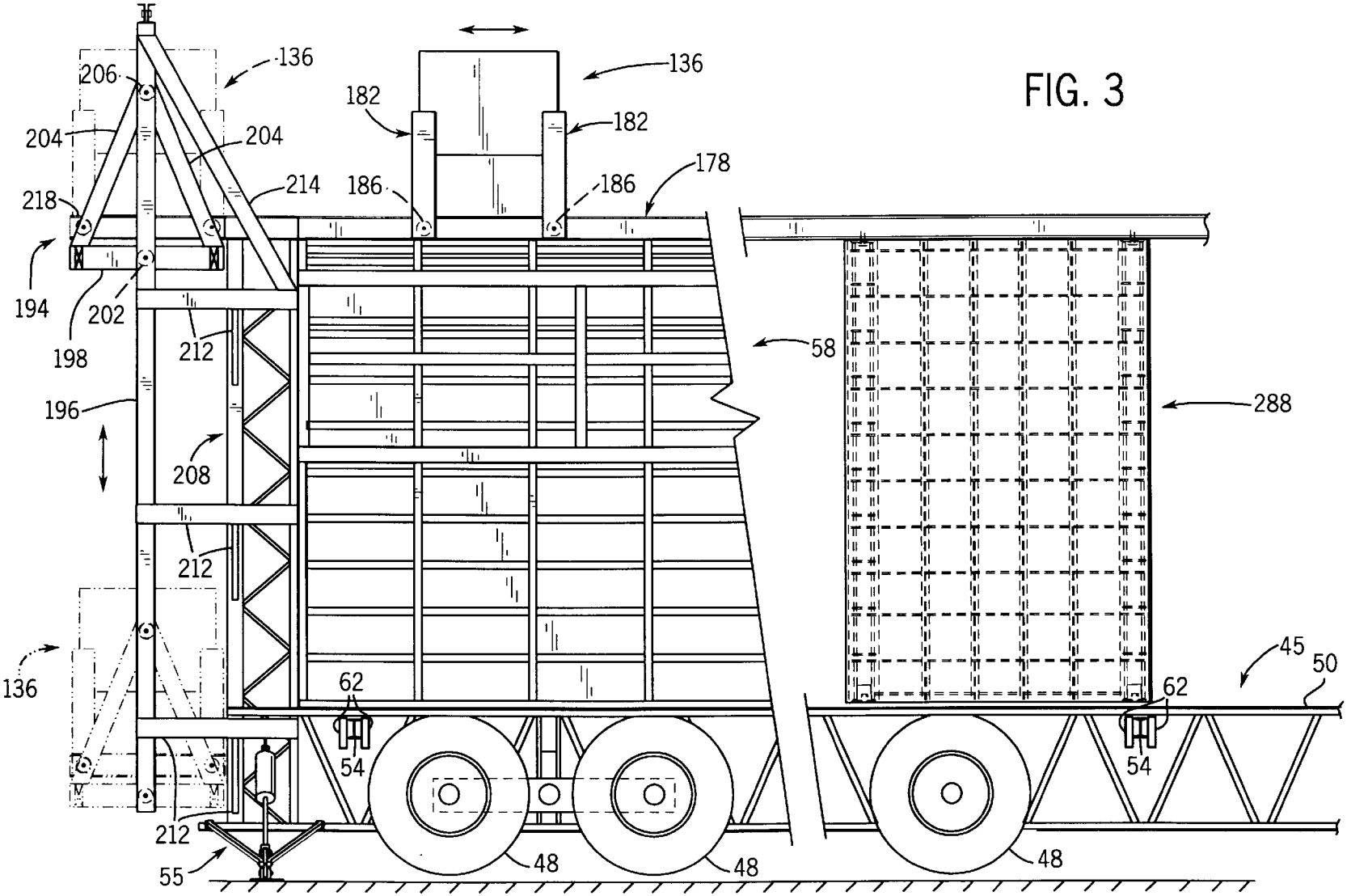
FIG. 3 is a side elevation view of the mobile form assembly of FIG. 2.

FIGS. 2 and 3 illustrate a form assembly 44 for use in constructing wall sections 40 and 42. Form assembly 44 generally includes a frame assembly 45 supporting a series of axles 46, each of which has ground-engaging wheels 48 rotatably mounted at its ends. The frame 45 of form assembly 44 includes a central vertical brace truss 50 and a pair of support members 52 extending upwardly and outwardly relative to brace truss 50. Support members 52 are mounted at their upper, outer ends to a rail member 54 which extends across the width of form assembly 44.

Form assembly 44 is self-supporting on the ground surface of a construction site. In a preferred form, form assembly 44 is provided with its own source of power, such as a hydraulic motor or any other satisfactory source, and is self-propelled when on-site. In a preferred form, a series of outriggers 55 are secured to the frame of form assembly 44 and are engageable with the ground surface for leveling form assembly 44.

Form assembly 44 further includes a pair of side form assemblies 56, 58, which are mirror images of each other and are substantially identical in construction, and like reference characters will be used to refer to like portions of each of side form assemblies 56, 58.

Side form assembly 56 includes a vertical form member 60 mounted at its lower end to a series of cross-members 62. An upright 64 is mounted to vertical form member 60 toward its upper end, and a series of angled braces 66 are interconnected with upright 64 adjacent its upper end. Braces 66 are secured at their lower ends to cross-member 62. A series of structural reinforcing members 68, 70 extend between braces 66 and vertical form member 60.

Each cross-member 62 includes a pair of spaced rollers 72 engaged with one side of a rail member 54 for providing lateral horizontal movement of side form assembly 56 between an inner, closed position and an outer, open position. Likewise, each cross-member 62 of side form assembly 58 includes a pair of spaced rollers engaged with the opposite side of a rail member 54, for providing movement of side form assembly 58 between an inner, closed position and an outer, open position.

Each vertical form member 60 defines a forming surface 74, and forming surfaces 74 face each other.

An external scaffold 76 is mounted to each side form assembly 56, 58. Each scaffold 76 includes vertical ladder structure 78 interconnected with side form assembly 56 or 58 via a lower cross-member 80 and an upper cross-member 82. A series of planks 83 are supported by cross-members 82, and are adapted to support a worker so as to provide access to the upper extent of each side form assembly 56, 58. Scaffold 76 is movable inwardly and outwardly along with side form assembly 56, 58 during movement between its open and closed positions.

Figure 9:
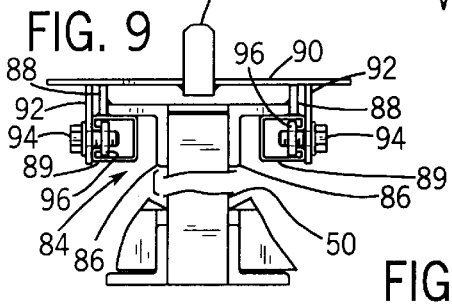
FIG. 9 is an enlarged partial section view showing the form bed assembly and bottom form member for the form assembly of FIG. 2, with reference to line 9—9 of FIG. 8.
Figure 8:
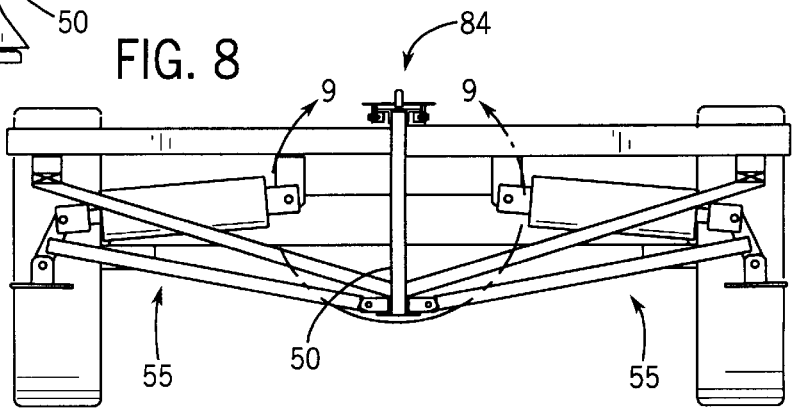
FIG. 8 is a partial section view showing the frame components of the form assembly of FIG. 2.

Referring to FIGS. 8 and 9, a form bed assembly 84 is mounted to the upper end of vertical brace truss 50, located toward the lower end of each of side form assemblies 56, 58. Form bed assembly 84 includes a pair of angle members 86 mounted to opposite sides of braces truss 50 and extending along the length of form assembly 44. A pair of vertical side straps 88 are welded to the outer ends of the horizontal flanges of angle members 86, extending upwardly therefrom. A unstrung rail 89 is mounted to the upper horizontal flange of each angle member 86 and to the lower end of each side strap 88, defining an outwardly open recess.

A bottom form assembly is engageable with form bed assembly 84, and includes a plate-like bottom member 90 defining an upwardly facing forming surface, with a pair of mounting straps 92 mounted to and extending downwardly from the lower surface of bottom member 90, outboard of side straps 88. A series of bolts 94 extend through an opening formed in each mounting strap 92, and the threaded shank of each bolt 94 is engaged with a threaded opening formed in a retainer 96 received within the passage of a unstrung rail 89. In this manner, the bottom form assembly can be easily mounted to and removed from form bed assembly 84.

A mounting stud 100 may be mounted to bottom member 90, extending upwardly from the upper surface thereof. Each mounting stud 100 is preferably threaded, and bottom form assemblies having mounting studs 100 are mounted to form bed assembly 84 at locations where columnar reinforcement or a core form assembly is to be located. The exact function of mounting studs 100 will later be explained.

The upwardly facing surface of bottom member 90 defines a bottom forming surface. As shown in FIG. 2, side form assemblies 56, 58 engage the side edges of bottom member 90 when in their closed position, such that side form surfaces 74 cooperate with the upwardly facing forming surface defined by bottom member 90 to form an upwardly open form cavity 102 between side form assemblies 56, 58.

A core form assembly, shown generally at 104, is adapted for placement within form cavity 102. The details of construction of core form assembly 104 and the manner in which it is mounted within form cavity 102 will later be explained.

As shown in FIGS. 2 and 6, a pair of vertically spaced face rail assemblies 106 are mounted to upright 64, extending inwardly from the inner surface of upright 64 toward form cavity 102. Each face rail assembly 106 includes an upper rail member 108 and a lower rail member 110, which are spaced apart from each other and configured so as to define a passage 112 having a mouth 114 which opens inwardly toward form cavity 102. A pocket 116 is defined between the lower rail member 110 of upper face rail assembly 106 and the upper rail member 108 of the lower face rail assembly 106.

A pair of form insert members 118, 120 are adapted for engagement with upper and lower face rail assemblies 106. Form insert member 118 includes a flat forming member 122 having upper and lower mounting members 124 extending outwardly therefrom. Each mounting member 124 includes an enlarged head end 125. Form insert member 120 includes coplanar upper and lower portions 126, 128, respectively. Form insert member 120 further includes an outwardly extending horizontal upper wall 130 extending from the lower end of upper wall portion 126, a vertical wall portion 132 extending vertically from the outer end of upper wall portion 130, and an angled lower wall portion 134 extending between the lower end of vertical wall portion 132 and the upper end of lower wall portion 128.

FIG. 2 illustrates form insert member 120 engaged with face rail assemblies 106 for mounting form insert assembly 120 to upright 64 above vertical form member 60. Form insert member 120 is employed when it is desired to form a wall section having a haunch for supporting a floor or ceiling member at the upper end of a wall section formed within form cavity 102, with the haunch being defined by concrete material received within the outwardly extending recess defined by upper horizontal wall portion 130, vertical wall portion 132 and angled lower wall portion 134. Upper and lower vertical wall portions 126, 128 are coplanar with forming surface 74 of vertical form member 60. Pocket 116 is sized and configured so as to receive the outwardly extending wall portions 130, 132 and 134 of form insert member 120 when mounted to face rail assemblies 106.

As can be appreciated, the enlarged head 125 of each mounting member 124 is received within passage 112 of one of face rail assemblies 106 for securing form insert member 120 to face rail assemblies 106. The enlarged head 125 of each mounting member 124 engages a shoulder defined between passage 112 and mouth 114, such that mounting member 124 extends through mouth 114 and the outwardly facing surface of wall portions 126, 128 engages the inwardly facing surfaces of upper and lower rail members 108, 110, respectively. With this construction, form insert members 118, 120 are axially movable into and out of engagement with face rail assemblies 106 by sliding longitudinal movement of each form insert member 118, 120 relative to face rail assemblies 106.

When it is desired to form a wall section having a vertical surface throughout its height, form insert member 120 is removed and replaced with form insert member 118, which defines a planar inwardly facing forming surface coplanar with forming surface 74 of vertical form member 60 when mounted to face rail assemblies 106.

The above-described form insert construction provides a quick and simple means for varying the configuration of a concrete member formed within a form assembly. As can be appreciated, any number of form insert configurations can be employed, depending upon the desired cross-sectional shape of the concrete member.

Figure 7:
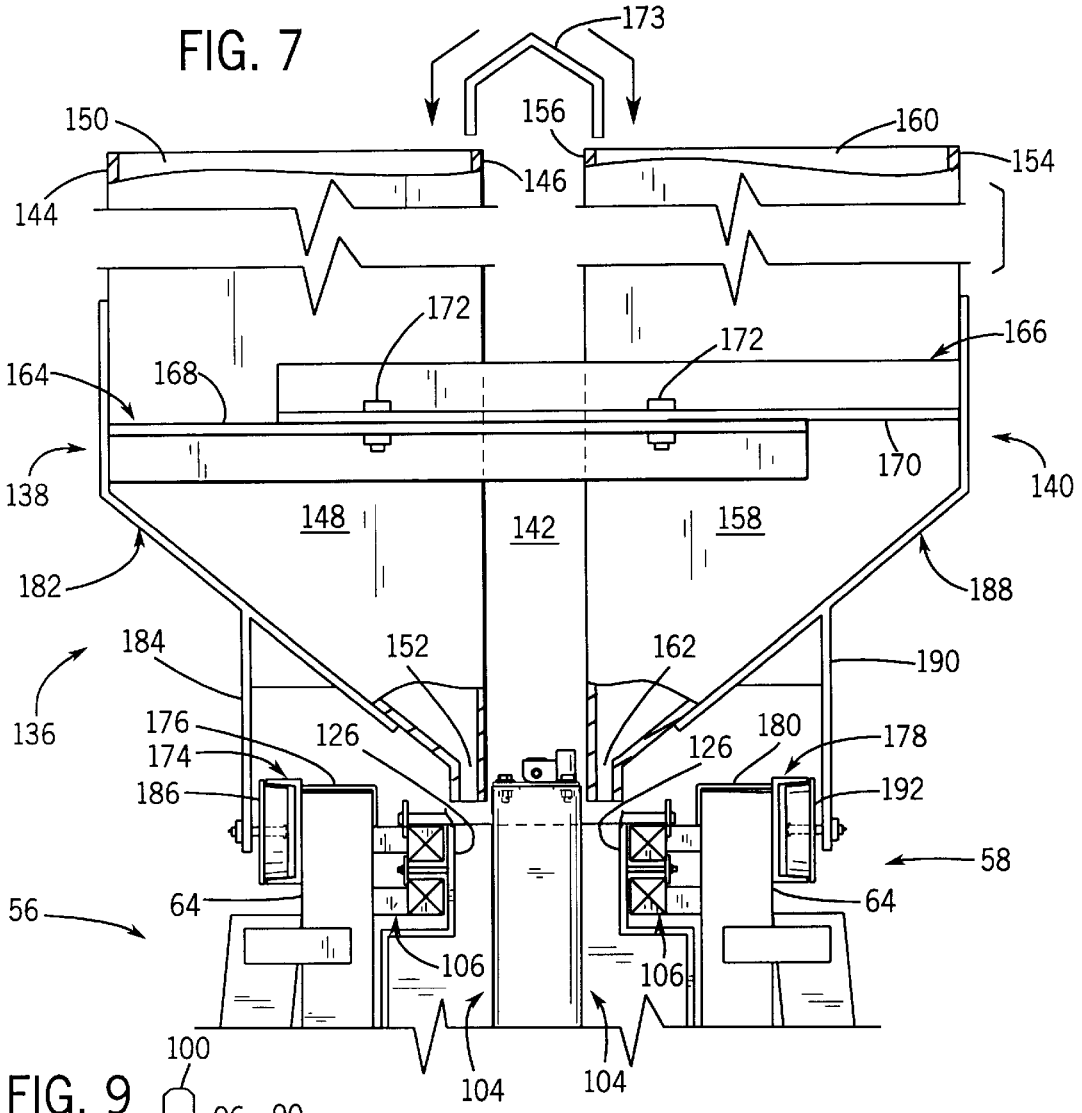
FIG. 7 is a partial end view, with portions in section, showing a hopper assembly for discharging concrete into the form cavity of the form assembly of FIG. 2.

As shown in FIGS. 2 and 7, a hopper assembly 136 is movably mounted to the upper end of each side form assembly 56, 58 for discharging concrete material into form cavity 102. Hopper assembly 136 includes a pair of hopper sections 138, 140 with a space 142 therebetween. Hopper section 138 includes an outer wall 144, an inner wall 146, and a pair of end walls 148, 150 extending between and interconnecting outer and inner walls 144, 146, respectively. Walls 144, 146, 148 and 150 cooperate to define an internal cavity which receives a quantity of concrete material. A downwardly facing discharge passage 152 is formed in the lower end of hopper section 138 adjacent side form assembly 56. Discharge passage 152 is illustrated as being formed between the lower end of inner wall 146 and a lower end portion of outer wall 144, although it is understood that any other satisfactory discharge structure may be employed for discharging concrete material from the internal cavity of hopper section 138 into form cavity 102. Discharge passage 152 is located between core form assembly 104 and the upper vertical wall section 126 of form insert member 120.

Similarly, hopper section 140 includes an outer wall 154, an inner wall 156, and end walls 158, 160 extending between and interconnecting outer and inner walls 154, 156, respectively. Walls 154, 156, 158 and 160 cooperate to define an internal cavity for receiving a quantity of concrete material within hopper section 140. A discharge passage 162 is formed in the lower end of hopper section 140, between the lower end of inner wall 156 and a vertical lower end portion of outer wall 154. Discharge passage 162 is located between core form assembly 104 and upper vertical wall portion 126 of form insert member 120 for discharging concrete material into form cavity 102 adjacent side form assembly 58.

A pair of angle members, one of which is shown at 164, are mounted to end walls 148, 150 of hopper section 138. Similarly, a pair of angle members, one of which is shown at 166, are mounted to end walls 158, 160 of hopper section 140. Angle member 164 defines an upwardly facing horizontal flange 168 and angle member 166 defines a downwardly facing horizontal flange 170. Angle members 164, 166 overlap each other, and flanges 168, 170 face and engage each other. Flanges 168, 170 include slot structure for receiving a pair of connectors 172, which may be in any satisfactory form such as nut and bolt assemblies, for maintaining hopper sections 138, 140 in a desired spaced relationship relative to each other. The spacing between hopper sections 138, 140 can be adjusted by loosening connectors 172 and repositioning hopper sections 138, 140 to a desired spaced relationship, and subsequently re-tightening connectors 172. As shown in FIG. 7, the upper end of core form assembly 104 is disposed between discharge passages 152, 162 of hopper sections 138, 140, respectively, and the variable spacing of hopper sections 138, 140 relative to each other functions to accommodate core form assemblies 104 having varying widths and varying distances between side form assemblies 56, 58.

A bridge member 173 overlies spaces 142 between hopper sections 138, 140. Bridge member 173 functions to prevent concrete from falling into space 142, and is preferably deformable to accommodate variations in the width of space 142 when the spacing between hopper sections 138, 140 is adjusted.

A channel-shaped outwardly facing rail member 174 is mounted to the upper end of upright 64 of side form assembly 56. An L-shaped mounting member 176 is mounted to rail member 174 and is secured to the upper end of upright 64 for securely mounting rail member 174 to upright 64. Similarly, a channel-shaped rail member 178 is mounted to the upper end of upright 64 of side form assembly 58 via an L-shaped mounting member 180.

Hopper section 138 is carried by a pair of support members 182 (FIGS. 3, 7) mounted to outer wall 144, and a strut 184 depends from each support member 182. A roller 186 is rotatably mounted to each strut 184 adjacent its lower end. Similarly, hopper section 140 is carried by a pair of support members 188 mounted to outer wall 154. A strut 190 depends from each support member 188, and a roller 192 is rotatably mounted to each strut 190 adjacent its lower end. As shown in FIG. 7, rollers 186, 192 are engaged with rail members 174, 178, respectively, being received within the outwardly facing channel structure defined by rail members 174, 178.

Movement of rollers 186, 192 within rail members 174, 178, respectively, enables hopper assembly 138 to be moved longitudinally along the length of side form members 56, 58, for discharging concrete material into form cavity 102. As can be appreciated, the spacing between rail members 174, 178 varies as side form assemblies 56, 58 are placed in different spaced relationships relative to each other to form concrete members having different widths. The variable position mounting arrangement by which hopper sections 138, 140 are interconnected enables rollers 186, 192 to remain in engagement with rail members 174, 178, respectively, by adjustment in the spacing between hopper sections 138, 140.

Figure 4:
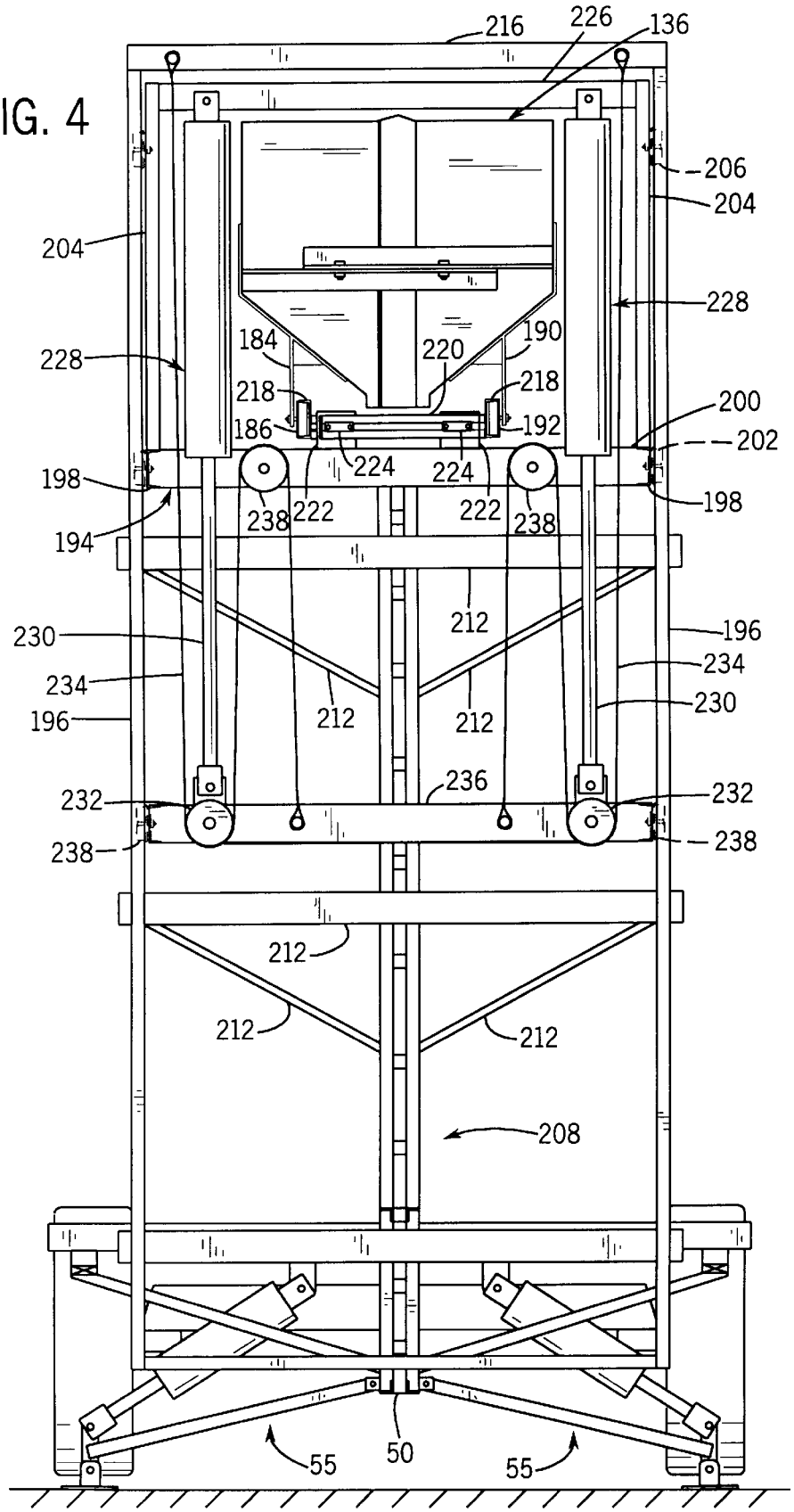
FIG. 4 is an end elevation view of the mobile form assembly of FIGS. 2 and 3.

FIG. 3 and FIG. 4 illustrate a lifting and lowering mechanism for moving hopper assembly 136 between a lowered position for receiving a quantity of concrete material, and a raised position for positioning hopper assembly 136 toward the upper end of form assembly 44. The hopper raising and lowering mechanism includes a carrier assembly 194 movably mounted to a pair of vertical rail members 196. Carrier assembly 194 generally includes a lower frame assembly formed of a pair of side frame members 198 and a pair of end frame members 200 extending between and connected to the ends of side frame members 198. Each side frame member 198 carries a roller 202, and each roller 202 is engaged with one of vertical rail members 196.

Pairs of frame braces 204 are mounted to the ends of lower side frame members 198, extending upwardly at an angle relative to each other and connected together at their upper ends. A roller 206 is rotatably mounted to frame braces 204, and each roller 206 is engaged with one of vertical rail members 196. With this arrangement, carrier assembly 194 is mounted for vertical movement to vertical rail members 196.

A vertical lift truss 208 is mounted to the end of truss brace 50. Lift truss 208 is interconnected with vertical rail members 196 via a series of frame supports 212 and upper frame braces 214. Vertical rail members 196 are connected at their upper ends via an upper cross-member 216.

Hopper carrier assembly 194 includes a pair of rail sections 218 (FIG. 4) which define outwardly facing channel structure and are configured like rail members 174, 178. Each rail section 218 is secured to the ends of a pair of slotted support brackets 220 mounted to a pair of spaced mounting blocks 222. Connectors 224 are engaged with blocks 222 and brackets 220. Connectors 224 can be selectively loosened and tightened relative to blocks 222 for adjusting the position of brackets 222 relative to blocks 222 and thereby the spacing between rail sections 218, to accommodate variations in the spacing between hopper rollers 186, 192 as dictated by the space between side form member rails 174, 178.

The upper ends of frame braces 204 are interconnected via a carrier assembly upper cross-member 226. As a means for raising and lowering carrier assembly 194, a pair of hydraulic cylinder assemblies 228 each has its cylinder end connected to cross-member 226 and its rod, shown at 230, connected to a sheave 232, which in turn is engaged with a cable 234. Each cable 234 is secured at its upper end to frame cross-member 216 and at its lower end to a slave beam 236, and sheaves 232 are rotatably mounted to slave beam 236. Rollers 238 are mounted at the ends of slave beam 236, and are engaged with vertical rail members 196. Each cable 234 is further trained about a sheave 238 rotatably mounted to end frame member 200 of carrier assembly 194.

Hopper carrier assembly 194 is moved to its raised position, as shown in FIG. 4, by extending the rods 230 of cylinder assemblies 228. Retraction of rods 230 into the cylinder of each cylinder assembly 228 results in lowering of hopper carrier assembly 194 to its lowered position as shown in phantom in FIG. 3, to enable placement of concrete into hopper sections 138, 140. The cable and slave beam assembly as illustrated provides vertical movement of hopper carrier assembly 194 three times the length of the stroke of cylinder rod 230.

When hopper carrier assembly 194 is in its raised position, shown in solid lines in FIG. 3, rail sections 218 are located in alignment with rail members 174, 178 of side form assemblies 56, 58, respectively. This enables hopper assembly 136 to be moved from hopper carrier assembly 194 onto rail members 174, 178 for positioning hopper assembly 136 so as to discharge concrete material through discharge passages 152, 162 into forming cavity 102 between side form assemblies 56, 58. After the concrete material has been fully discharged from hopper assembly 136, hopper assembly 136 is returned to hopper carrier assembly 194 and is subsequently lowered for loading another charge of concrete material into hopper assembly 136. This process is repeated until the form cavity 102 is completely filled.

Referring to FIG. 5, a series of removable scaffold assemblies 240 are adapted for mounting to side form assembly 56 when side form assembly 56 is in its open position and moved away from form bed assembly 84. Each scaffold assembly 240 includes a series of vertical members 242, each of which defines an upper end and a lower end. A support member 244 extends from the lower end of each vertical support member 242, and an upper engagement member 246 extends from the upper end of each vertical member 242 in a direction opposite that of lower support member 244. A vertical lip 248 extends downwardly from the outer end of each engagement member 246. An intermediate support member 250 extends from each vertical member 242, and is located between lower support member 244 and upper engagement member 246.

The vertical support 242 of each scaffold assembly 240 is engaged with the side form assembly, such as 56, when the side form assembly is in its open position as shown in FIG. 5. The upper end of each vertical member 242 cooperates with engagement member 246 and lip 248 to define a hook-like structure which engages the upper end of side form assembly upright 64 and its associated rail member 174, to suspend each vertical member 242 from the side form assembly. Each vertical member 242 engages forming surface 74 of vertical form member 60 while engagement member 146 and lip 248 engage rail member 174 and the upper end of upright 64, to maintain each vertical member 242 in position relative to the side form assembly. When so positioned, a series of planks 252 are placed on support members 244 and 246. Each plank 252 is supported along its length by the spaced vertical members 242 and their associated horizontal support members 244, 250. Lower horizontal support members 244 are provided at an elevation enabling a worker to stand on planks 252 and have access to form bed assembly 84. Intermediate support members 250 and planks 252 supported thereby are positioned so as to enable a worker to have access to the upper portions of each side form assembly.

Scaffold assembly 240 enables workers to secure reinforcement structure to form bed assembly 84 when side form assembly 56 is in its open position. While not shown in the drawings, a scaffold assembly 240 may also be engageable with side form assembly 58 when moved to its open position, to provide access to both sides of form bed assembly 84. Once the reinforcement structure has been secured to form bed assembly 84 when one or both of side form assemblies 56, 58 are moved to their open positions and use of scaffold assembly 240 is no longer required, scaffold assembly 240 is disengaged from the side form assembly by removing planks 252 and subsequently lifting upwardly on each vertical member 242, to remove vertical members 242 from between side form assemblies 56, 58. Side form assemblies 56, 58 are then returned to their closed positions in preparation for placement of concrete material into form cavity 102 defined thereby.

Various structural and mechanical components are mounted within forming cavity 102 prior to movement of side form assemblies 56, 58 to their closed positions. For example, a metal door frame is secured to bottom forming member 90 and one of side form assemblies 56, 58 in a desired position in the wall section prior to moving the side form assemblies 56, 58 to their closed positions. Metal window frames can also be mounted to one of side form assemblies 56, 58. Openings for wood windows or doors are formed by placing assembled, treated lumber frames within the forming cavity 102 and subsequently removing the frames after the wall section is removed from the form assembly. Mechanical components, such as electrical conduit or plumbing pipes, can also be placed within the forming cavity 102 in desired positions and capped for being cast directly into the wall section.

Figures 10, 11, 15, 20:
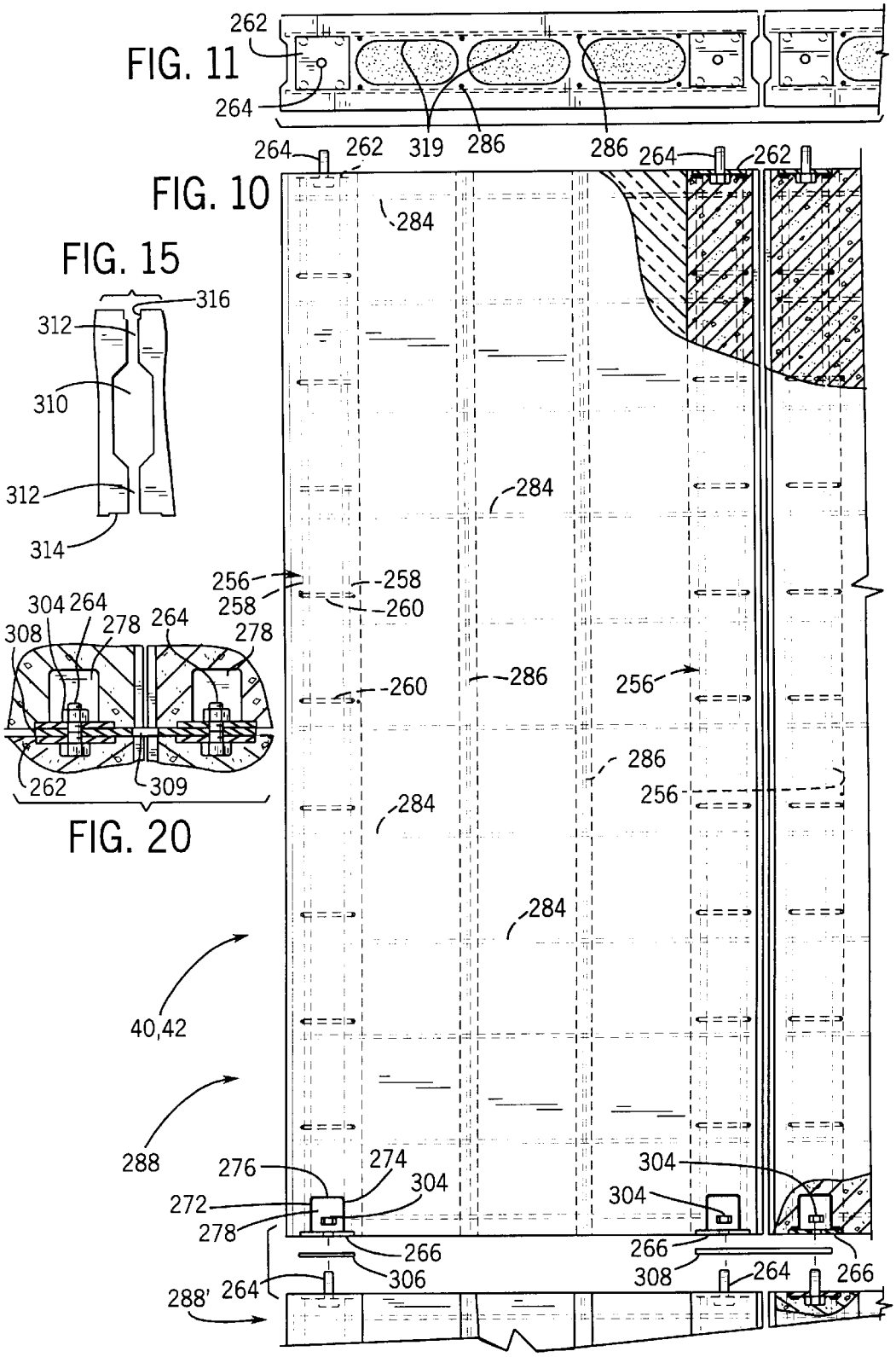
FIG. 10 is a side elevation view of the reinforced concrete wall section constructed utilizing the form assembly of FIGS. 1–9, showing the reinforced concrete wall section structure placed above and adjacent like reinforced concrete wall sections for constructing a multi-story building.
FIG. 11 is a top plan view of the reinforced concrete wall sections shown in FIG. 10.
FIG. 15 is an enlarged partial plan view showing the ends of the adjacent wall sections of FIG. 17.
FIG. 20 is an enlarged partial section view showing the manner in which adjacent wall sections are secured to underlying wall sections and to each other.

FIG. 10 illustrates a representative wall section 288 formed utilizing form assembly 44. As shown in the drawings, wall section 288 may be an interior wall section such as 42, although the description of wall section 288 is applicable to any of the reinforced concrete members forming a part of the building of FIG. 1.

Referring to FIG. 10, each wall section 40, 42 includes end columnar reinforcement structures, shown generally at 256. Columnar reinforcement structures 256 include a series of vertical reinforcement members 258 and a series of closed loop-type horizontal reinforcement members 260 which surround vertical reinforcement members 258. In a preferred form, horizontal reinforcement members 260 are square or rectangular in plan, and each vertical reinforcement member 258 is welded to one of the inside corners of each horizontal reinforcement member 260.

An upper attachment plate 262 is mounted to the upper end of each vertical reinforcing member 258. Attachment member 262 is in the form of a rectangular plate welded to the upper ends of vertical reinforcing members 258, and a threaded stud 264 is mounted to upper attachment member 262, such that the threaded shank of stud 264 extends upwardly from the upper surface of upper attachment member 262.

A lower mounting member 266 is mounted to the lower end of each columnar reinforcement structure 256. Lower mounting member 266 is in the form of a plate welded to the lower ends of vertical reinforcing members 258.

Figures 12, 13, 14, 16, 17, 18, 19:
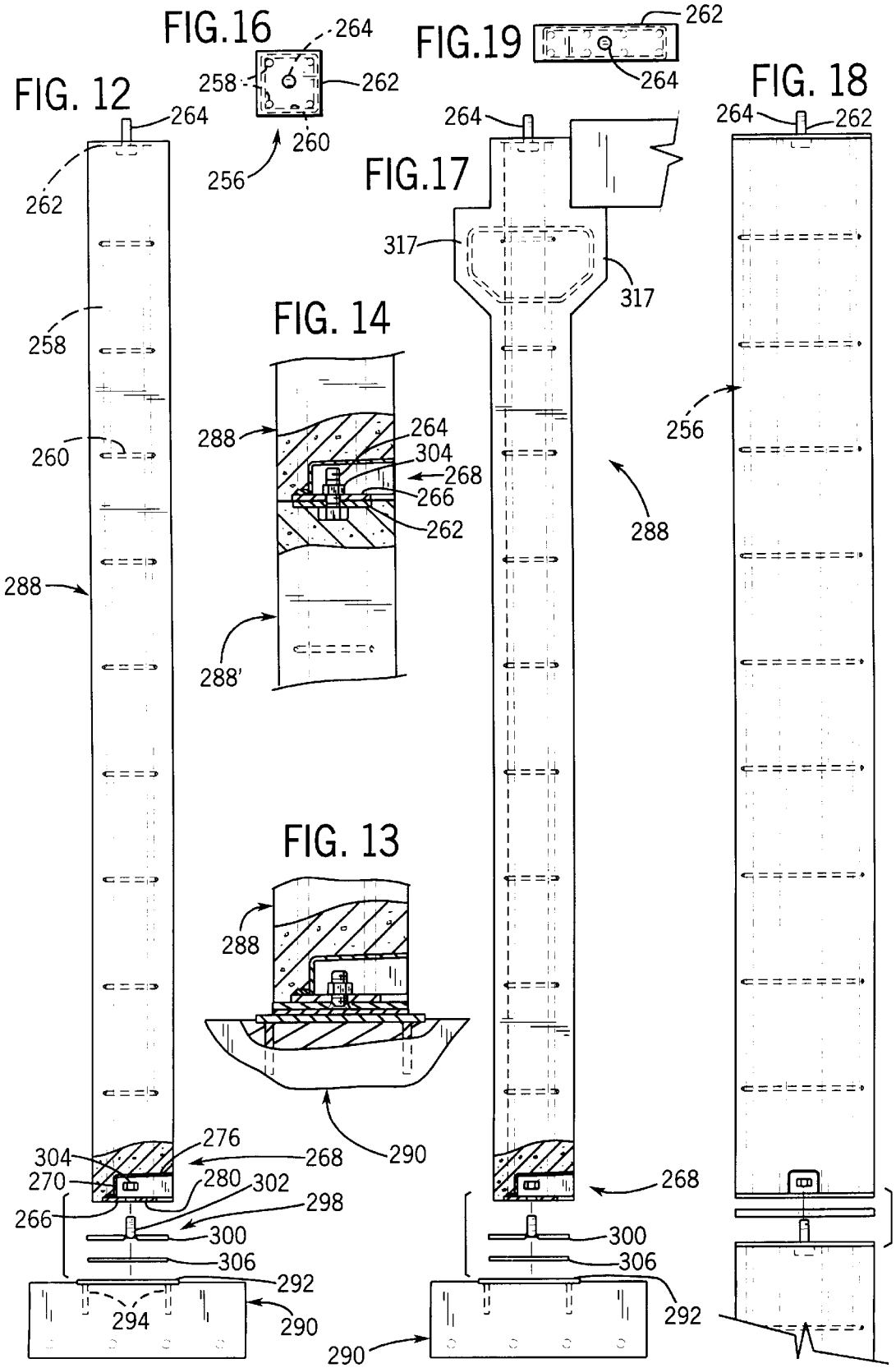
FIG. 12 is an end elevation view, with a portion in section, showing the reinforced concrete wall section of FIG. 10 for mounting to a footing.
FIG. 13 is an enlarged partial section view showing the reinforced concrete wall section of FIG. 10 as mounted to a base plate forming a part of a footing.
FIG. 14 is a view similar to FIG. 13, showing interconnection of a pair of reinforced concrete wall sections constructed in accordance with FIGS. 10, 11 and 12.
FIG. 16 is a top plan view of an upper attachment member forming a part of a columnar reinforcement structure cast into the reinforced concrete wall section of FIG. 10.
FIG. 17 is a view similar to FIG. 11, showing an alternative reinforced concrete wall structure constructed utilizing the form system of FIGS. 2–9.
FIG. 18 is a view similar to FIGS. 11 and 17, showing yet another alternative wall configuration constructed utilizing the form system of FIGS. 2–9.
FIG. 19 is a view similar to FIG. 16, showing an attachment member forming a part of a columnar reinforcement structure for the reinforced concrete wall section of FIG. 18.

Referring to FIG. 12, cavity structure, shown generally at 268, is mounted to the upper surface of each lower mounting member 266. Cavity structure 268 includes an inner wall 270, a pair of side walls 272, 274 and a top wall 276 extending between and interconnecting the upper ends of inner wall 270 and side walls 272, 274. Inner wall 270 and side walls 272, 274 are secured along their lower edges to the upper surface of lower mounting member 266. Side walls 272, 274 and top wall 276 terminate in a common plane which, as will hereinafter be described, is coplanar with the side surface of a reinforced wall structure into which cavity structure 268 is cast.

Cavity structure 268 cooperates with the upper surface of lower mounting member 266 to define an outwardly-opening passage or cavity 278. Lower mounting member 266 includes an opening 280 which establishes communication between the bottom surface of lower mounting member 280 and cavity 278.

Each columnar reinforcement structure 256 is positioned within form cavity 102 as shown in FIG. 5. To position each columnar reinforcement structure 256, the columnar reinforcement structure 256 is placed over one of the threaded bottom form assembly studs 100 (FIG. 9), such that stud 100 extends through opening 280 in lower mounting member 266 into cavity 278. A nut is then engaged with stud 100 to temporarily fix columnar reinforcement structure 256 to bottom member 90 of form bed assembly 84. The upper end of each columnar reinforcement structure 256 is engaged with each side form assembly 56, 58 via a tie rod 282 engageable with stud 264.

As noted previously, studs 100 are located along the length of form bed assembly 84 at predetermined intervals where one of columnar reinforcement structures 256 is to be placed.

Once columnar reinforcement structures 256 are placed within form cavity 102 and secured to form bed assembly bottom member 90 and the upper end of each columnar reinforcement structure 256 is fixed in position utilizing tie rod 282, horizontal reinforcing members 284 are secured to the vertical reinforcing members 258 of each columnar reinforcement structure 256 at predetermined vertical spacing along the height of columnar reinforcement structures 256. Intermediate vertical reinforcing members 286 are then secured to horizontal reinforcing members 284. Columnar reinforcement structures 256 are preferably prefabricated, either off-site or on-site, in any satisfactory manner and the components of each columnar reinforcement structure 256 are preferably welded together. Horizontal reinforcing members 284 may be fixed to the vertical reinforcing members 258 of columnar reinforcement structures 256 in any satisfactory manner, such as by utilizing wire ties or by welding. Similarly, vertical reinforcing members 286 may be secured to horizontal reinforcing members 284 in any satisfactory manner, such as by utilizing wire ties or by welding.

After columnar reinforcement structures 256 are mounted to bottom plate member 90 and horizontal reinforcing members 284 are tied to columnar reinforcement structures 256 and vertical reinforcing members 286 are secured to horizontal reinforcing members 284, scaffold assembly 240 is removed from between side form assemblies 56, 58 and side form assemblies 56, 58 are moved together to their closed position in which the forming surface 74 of each vertical form member 60 engages a side edge of bottom plate member 90 to define forming cavity 102. Hopper assembly 136 is then moved to its lowered position and hopper sections 138, 140 are filled with concrete material. Hopper assembly 136 is then moved to its raised position and rollers 186, 192 are moved into engagement with upper rail members 174, 178, respectively. Hopper assembly 136 is moved along upper rail members 174, 178 while discharge passages 152, 162 are maintained open, so that concrete material from hopper sections 138, 140 is discharged into forming cavity 102. Prior to pouring concrete material into forming cavity 102, the upper end of each columnar reinforcement structure 256 is secured utilizing a tie 282 to each of side form assemblies 56, 58. While concrete is being poured into form cavity 102, vibration is imparted to the forming surface of each of side form assemblies 56, 58 for settling the concrete material in form cavity 102 to prevent formation of air pockets. After form cavity 102 is filled, hopper assembly 136 is returned to hopper carrier assembly 194, and can be employed for filling the form cavity of another wall section formed utilizing additional side form assemblies 56, 58 mounted to form assembly 44.

After the reinforced concrete wall section formed within form cavity 102 has initially cured, e.g. for approximately ten (10) hours and while the concrete is still relatively green, side form assemblies 56, 58 are moved apart such that forming surfaces 74 are moved away from the side surfaces of the reinforced concrete wall section, such as shown in FIG. 11 at 288. A lifting device, such as a crane, is then secured to wall section 288 by engaging upper attachment studs 264.

When concrete material is placed within form cavity 102, the forming surface 74 defined by one of side form assemblies 56, 58 engages the outer ends of walls 270–276 which define cavity structure 268, to seal cavity 278 and prevent entry of concrete material into cavity 278. After side form assemblies 56, 58 are moved to their open positions when the concrete material of wall section 288 has initially cured, the nut engaged with threaded stud 100 extending from bottom plate member 90 is accessed through cavity 278 and is disengaged from stud 100. The crane is then operated to lift reinforced concrete wall section 288 out from between side form assemblies 56, 58.

During lifting of reinforced concrete wall section 288, the vertical lifting force imparted to upper attachment studs 264 is transferred directly to each columnar reinforcement structure 256 through upper attachment plate 262, and to the bottom of concrete wall section 288 through lower mounting member 266. This enables concrete wall structure 288 to be withdrawn from form assembly 44 at a relatively early stage before the concrete material of wall section 288 is fully cured, which functions to increase cycle time for wall sections produced utilizing form assembly 44. Wall section 288 is then moved utilizing the crane or any other satisfactory lifting mechanism and placed in position in a wall, as shown in FIG. 1.

FIG. 12 shows the manner in which concrete wall section 288 is placed on a support member, such as a footing 290. A base plate 292 is cast into footing 290, and includes vertical extensions 294 secured within the concrete of footing 290. An attachment member 298, which includes a plate 300 and an upstanding threaded stud 302, is interposed between mounting plate 266 and base plate 292. A shim plate 306 is placed between attachment plate 300 and base plate 292, and is configured such that attachment plate 380 is level. Base plate 292, attachment plate 300 and shim plate 306 are then welded together, and wall section 288 is lowered toward footing 290 such that stud 302 extends through mounting plate opening 280 and into cavity 278. A nut 304 is then engaged with stud 302 to mount wall section 288 to footing 290.

The mounting system as illustrated in FIG. 12 is carried out at each columnar reinforcement structure 256 for each wall section 288, such that each wall section 288 is mounted to footing 290 as described in two spaced locations. With this arrangement, wall section 288 is securely mounted to and retained in position on footing 290. FIG. 13 illustrates the mounting system shown and described above, with the various components in position as secured together to mount wall section 288 to footing 290.

FIG. 14 illustrates mounting of identical wall sections 288, 288' to each other, such as when constructing a multistory building. As described previously, upper wall section 288 includes mounting plate 266 and cavity structure 268 at its lower end. The concrete defining the bottom surface of wall section 288 is configured such that the downwardly facing surface of mounting plate 266 is exposed. Lower wall section 288' includes upper attachment plate 262 and stud 264 extending upwardly therefrom, and the concrete defining the upper surface of wall section 288 is configured such that the upwardly facing surface of attachment plate 262 is exposed. Upper wall section 288 is placed on lower wall section 288' such that stud 264 extends through mounting plate opening 280 and into cavity 278 defined by cavity structure 268, and the facing surfaces of lower mounting plate 266 and upper attachment plate 292 are in engagement with each other. A nut 304 is then inserted through cavity 278 and engaged with stud 264. Nut 304 is tightened down against the upper surface of mounting plate 266, to securely attach upper wall section 288 to lower wall section 288'. The columnar reinforcement structures 256 of each of upper wall section 288 and lower wall section 288' are thus in vertical alignment with each other, and the vertical loads on wall sections 288, 288', and any other similarly mounted wall sections, are transferred through the columnar reinforcement structures 256 of each wall section and ultimately to footing 290.

FIG. 10 illustrates the manner in which an upper wall section 288 is mounted to a lower wall section 288' and alignment of the columnar reinforcement structures 256 of each wall section when the wall sections are secured together. FIG. 10 illustrates use of a shim 306 between the lower mounting plate 266 of upper wall section 288 and attachment plate 262 of lower wall section 288'. Shim 306 may be in the form as shown at the leftward end of FIG. 10, in which a single shim is disposed between mounting plate 266 and attachment plate 292. Alternatively, a bridging shim 308 may be employed to span between lower mounting plates 266 and attachment plates 262 of adjacent wall sections. In either event, the shims such as 306, 308 are first leveled and then welded to upper attachment plates 292, and the upper wall section such as 288 is then placed on the lower wall section such as 288'.

Bridging shim 308 includes a pair of openings, each of which is adapted to receive one of attachment studs 264. The adjacent wall sections 288 are placed relatively close together, and it is contemplated that spacing of one-eighth inch or less can be accomplished between adjacent wall sections. Bridging shim 308 includes an opening 309 (FIG. 20) overlying the space between adjacent wall sections so as to enable grout material to be placed into the space between the wall sections.

FIG. 15 illustrates the configuration to which the end surface of which each wall section 288 is formed. Each wall section 288 preferably includes an indentation which runs the full height of the wall section, and the facing indentations of adjacent wall sections cooperate to define a recess 310 for receiving the grout material. The spacing between adjacent wall sections 312 on either side of recess 310 will be sufficiently close together to prevent the grout material placed within recess 310 from running out between the wall sections 288. Each wall section 288 further includes a shallow indentation 314 on its interior side, and indentations 314 receive tape or other satisfactory structure for covering the joint between adjacent wall sections. When the wall is fully constructed, the interior surfaces of each wall section and the taped joint therebetween are covered with an acoustical spray so as to provide an aesthetically appealing and uniform surface to the wall.

Each wall section further includes a somewhat deeper and shorter indentation 316 at each exterior comer. Facing indentations 316 receive exterior filler material such as caulk to seal the joints between the adjacent wall sections.

FIG. 16 shows a top plan view of columnar reinforcement structure 256 incorporated into the ends of wall section 288.

FIG. 17 illustrates an alternative construction for wall section 288. In this embodiment, wall section 288 is provided with haunches 317 defining an upwardly facing shoulder for mounting a floor to wall section 288. Each haunch 317 may be formed such as by utilizing form insert 120 (FIG. 6), and adequate reinforcement is secured to columnar reinforcement structures 256 so as to reinforce haunches 317.

FIG. 18 illustrates yet another alternative wall section construction. This embodiment is generally similar to wall section 288 as illustrated in FIGS. 10–12, but is provided with an increased thickness. FIG. 19 illustrates the construction of the upper end of a columnar reinforcement structure incorporated into the wall section of FIG. 18 in place of the columnar reinforcement structure 256 illustrated in FIG. 16 and used in the wall section of FIGS. 10–12.

FIGS. 21–26 illustrate a representative core form assembly 104 for forming vertical cores in a concrete wall section such as 288 formed utilizing form assembly 44. Referring to FIG. 11, such cores are illustrated at 319, and are spaced along the length of each wall section 288 at predetermined intervals. Core form assembly 104 is adapted for mounting to form bed assembly 84 of form assembly 44.

As noted previously, bottom form member 90 is mounted to form bed assembly 84 by securing mounting straps 92 to unstrung rails 98 utilizing bolts 94 and nuts 96. Studs 100 are fixed to the center portion of bottom form member 90 so as to extend upwardly relative to bottom form member 90. Bottom form member 90 also includes slots 320, located on either side of stud 100. Slots 320 extend such that the longitudinal axis of each slot 320 extends transversely relative to bottom form member 90.

Figure 21:
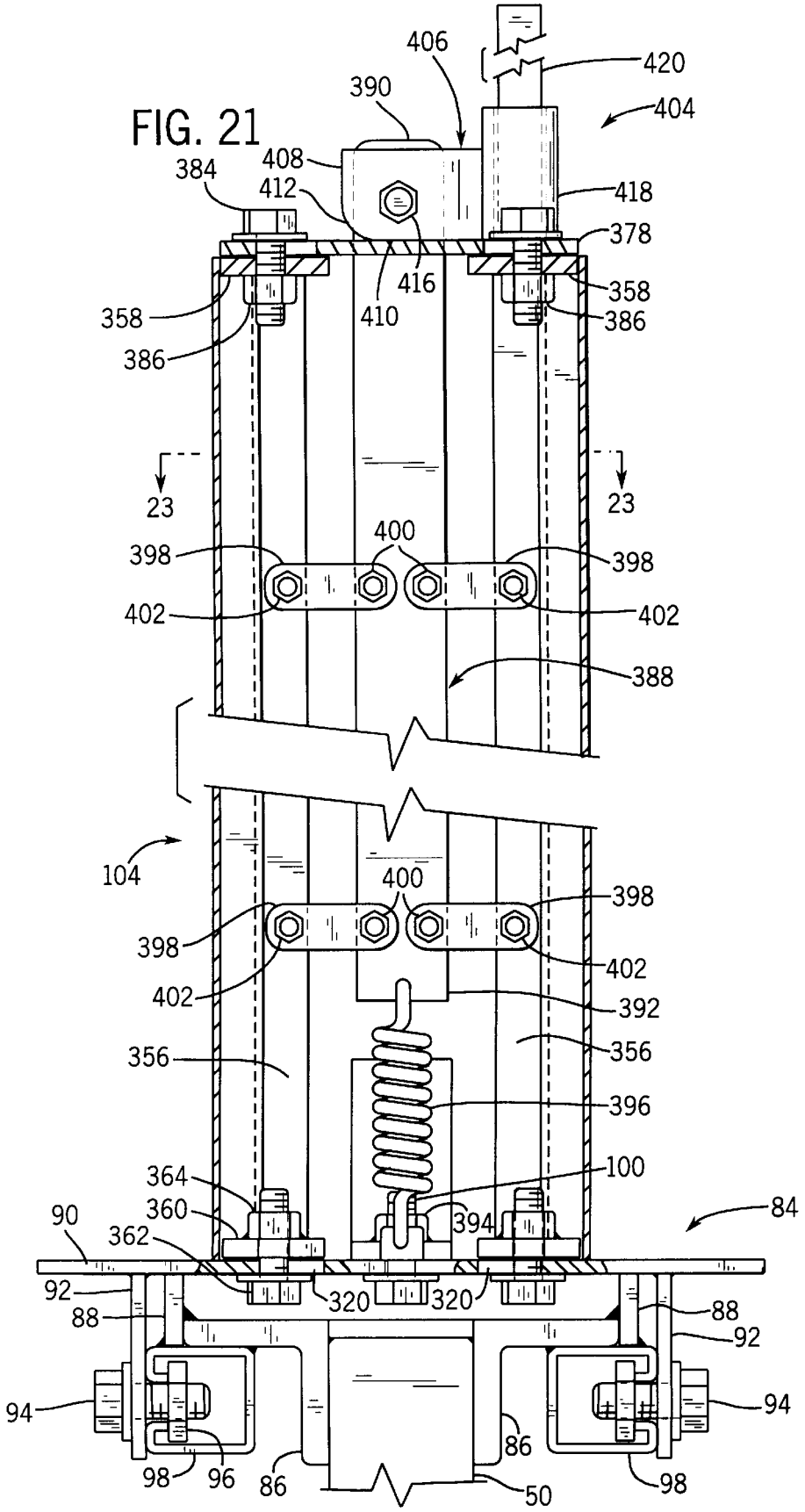
FIG. 21 is a section view of a core form assembly for use in the form assembly of FIGS. 2–9 for forming a core in a concrete wall member, with reference to line 21—21 of FIG. 22.
Figure 22:
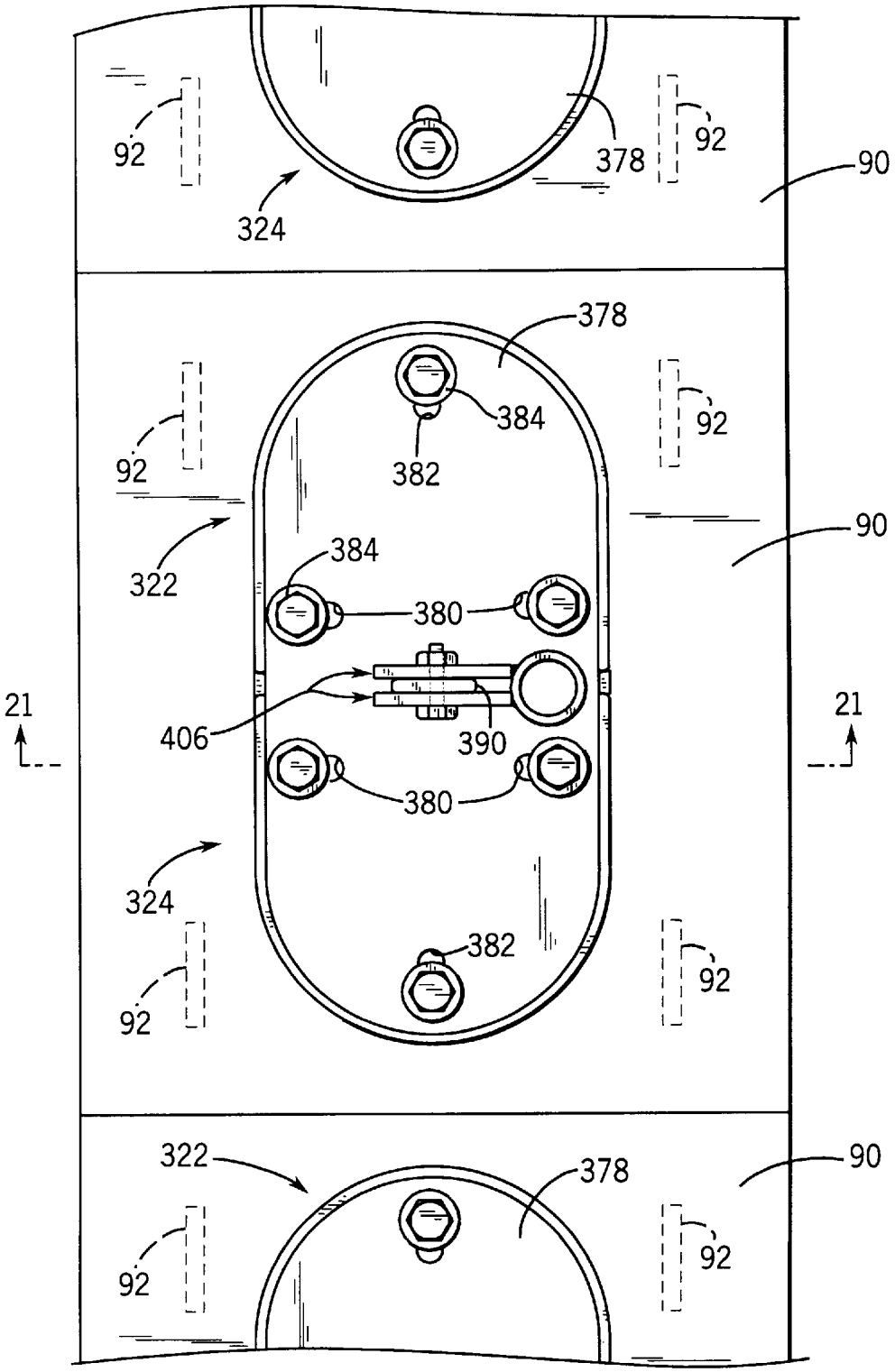
FIG. 22 is a top plan view of the core form assembly of FIG. 21, showing multiple core form assemblies ganged together.
Figure 23:
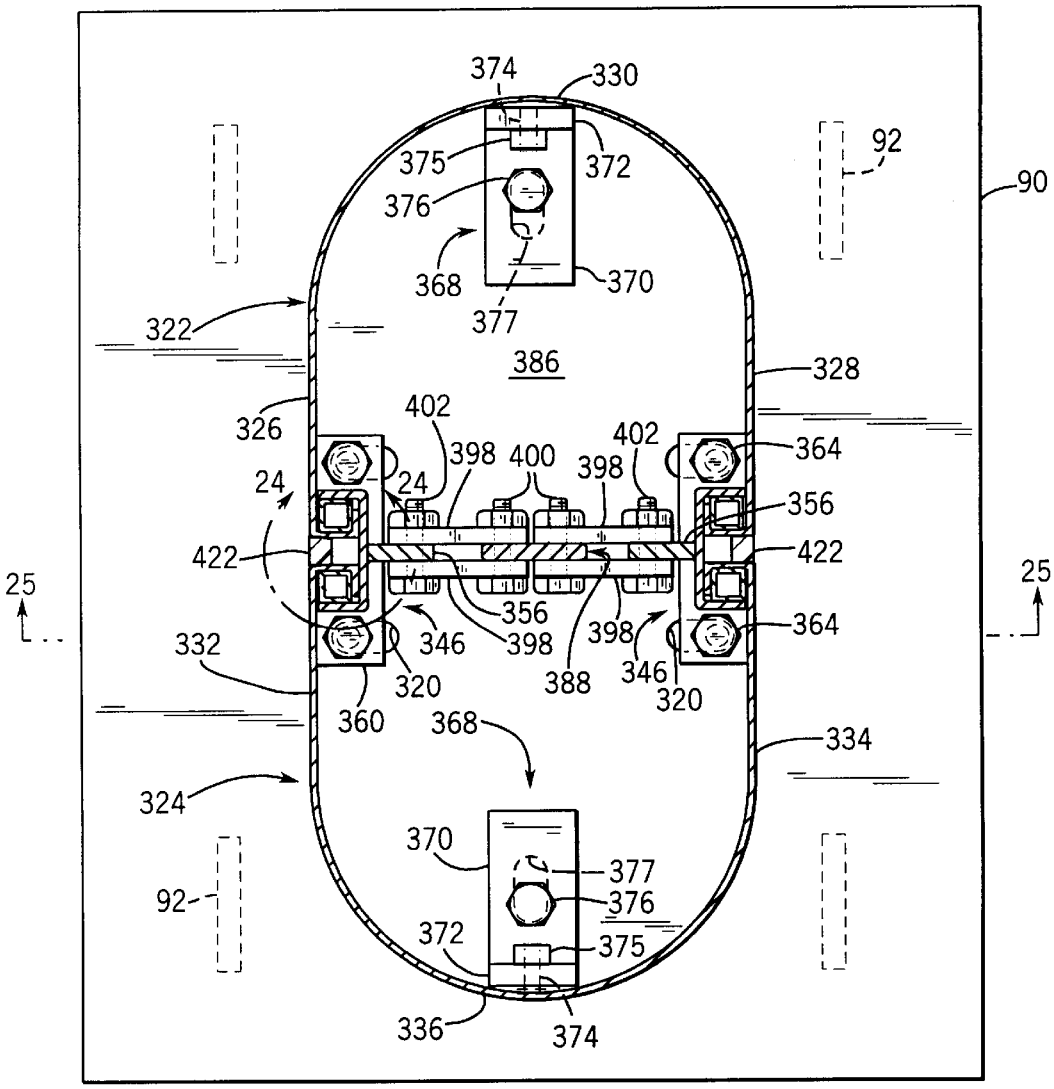
FIG. 23 is a section view taken along line 23—23 of FIG. 21.

Referring to FIGS. 21–23, core form assembly 104 includes a pair of mirror image outer wall sections 322, 324. Wall section 322 includes spaced, parallel straight wall portions 326, 328 and a curved wall portion 330 extending between and interconnecting parallel wall portions 326, 328. Similarly, wall section 324 includes a pair of straight, parallel wall portions 332, 334 and a curved wall portion 336 extending between and interconnecting straight wall portions 332, 334.

Figure 24:
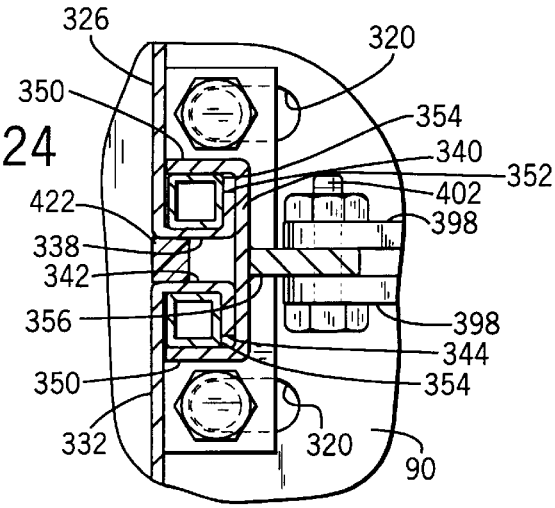
FIG. 24 is an enlarged partial section view with reference to line 24—24 of FIG. 23.

Straight wall portions 326, 328 and 332, 334 each have a channel configuration at its end opposite curved wall portions 330, 336, respectively. Referring to FIG. 24, the channel configuration at the end of straight wall portion 326 is defined by an inwardly extending lip 338 which is perpendicular to wall portion 326, and an inner end section 340 extending perpendicular to lip 338 and parallel to wall portion 326. Similarly, wall portion 332 has a channel configuration defined by an inwardly extending lip 342 which extends inwardly perpendicular to wall portion 332, and an end section 344 extending perpendicular to lip 342 and parallel to wall portion 332. Lips 338, 342 are spaced from each other. Wall portion 328 has a channel configuration at its end which is a mirror image of the channel configuration shown in FIG. 24 with respect to wall portion 326, and likewise wall portion 334 has a channel configuration at its end which is a mirror image of the channel configuration shown in FIG. 24 with respect to wall portion 332.

A retainer assembly 346 is engaged with the channel structure at the facing ends of wall portions 326, 332 and at the facing ends of wall portions 328, 334. Each retainer assembly 346 includes a C-shaped channel defining a pair of flanges 350 interconnected via a web 352. A tube 354 is mounted to the inwardly facing surface of each flange 350. Each tube 354 has an external cross-section which corresponds in shape to the internal cross-section of the channel structure defined by wall portions 326, 332, such that tubes 354 are received within the wall portion channel structure as shown in FIGS. 23 and 24. Wall portions 328, 334 are also interconnected in a similar manner via a retainer assembly 346.

Each retainer assembly 346 further includes a bar 356 mounted to the outer surface of each channel web 352, extending inwardly relatively to wall sections 322, 324. In addition, top and bottom end plates 358, 360, respectively, are mounted to the upper and lower ends, respectively, of the retainer assembly channel member. Bolts 362 extend through bottom forming member slots 320 and into and through openings formed in bottom end plates 360. A nut 364 is welded to each bottom end plate 360 over each opening formed therein, such that bolts 362 function to securely mount core form assembly 104 to bottom forming plate 90.

Referring to FIG. 23, a pair of angle members 368 are located at the lower end of each wall section 322, 324. Each angle member 368 includes a horizontal flange 370 engaged with the upper surface of bottom forming member 90, and an upstanding vertical flange 372 located adjacent the inner surface of each curved wall section 330, 336. A stud 374 is fixed to each of wall sections 330, 336 and extends through an opening formed in vertical flange 372. A nut 375 is engaged with stud 374 for securing each of wall sections 330, 336 with the vertical flange 372 of angle member 368. A bolt 376 extends through an opening formed in angle member horizontal flange 370 and through a slot 377 formed in forming member 90 which extends perpendicularly to slots 320.

Core form assembly 104 further includes an upper plate 378, which overlies top end plates 358. As shown in FIG. 22, upper plate 378 has a shape corresponding to the shape defined by wall sections 322, 324, and is configured such that the side edges of upper plate 378 are spaced inwardly from the outer surfaces of wall sections 322, 324. Upper plate 378 includes spaced, opposed pairs of transverse slots 380 and a pair of spaced, opposed longitudinal slots 382. Transverse slots 380 are in vertical alignment with transverse slots 320 in bottom forming plate 90, and longitudinal slots 382 are in vertical alignment with longitudinal slots 377 formed in bottom forming plate 90. Bolts 384 extend through slots 380, 382, and are mounted to nuts 386 secured to top end plates 358, extending through openings formed in top end plates 358 in alignment with the threaded opening of each nut 386.

For reasons to be explained hereafter, bolts 384 and 362 are tightened to prevent vertical movement between bottom forming plate 90, upper plate 378 and the components therebetween, but are not fully torqued such that bottom end plates 360 can be moved laterally relative to bottom forming plate 90 and top end plates 358 can be moved laterally relative to upper plate 378.

Wall sections 322, 324 cooperate to define an internal passage 386 extending between the upper and lower ends of core form assembly 104. An actuator rod 388 extends longitudinally within passage 386 in a direction parallel to the longitudinal axis of core form assembly 104. Actuator rod 388 defines an upper end 390 which extends through an opening formed in upper plate 378 and is located exteriorly thereof. Actuator rod 388 further defines a lower end 392 spaced above the upper surface of bottom forming plate 90. A catch member 394 is secured to stud 100, and a spring 396 has one end connected to actuator rod lower end 392 and an opposite end connected to catch 394. Spring 396 functions to bias actuator rod 388 downwardly relative to core form assembly wall sections 322, 324.

A series of spaced, opposed sets of links 398 interconnect actuator rod 388 with each retainer 346. Each link 398 is pivotably connected adjacent an inner end to actuator rod 388 via a connector 400, and is pivotably connected adjacent its outer end to vertical bar 356 of each retainer assembly 346 via a connector 402.

A handle assembly 404 is connected to the upper end 390 of actuator rod 388. Handle assembly 404 includes a cam member 406 defining an end surface 408, a side surface 410 and a cam surface 412 extending therebetween, and cam member 406 is pivotably mounted to the upper end 390 of actuator rod 388 via a connector 416. A handle receiver 418 is mounted to the end of cam member 406 opposite its end surface 408, and handle receiver 418 defines an internal passage adapted to receive the end of a handle member 420.

In operation, core form assembly 104 functions as follows.

Figure 25:
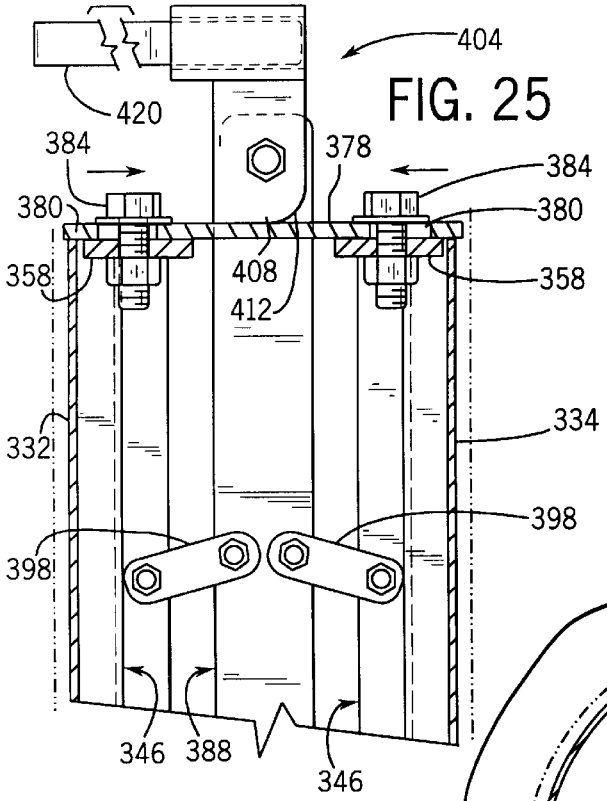
FIG. 25 is a partial section view showing the upper end portion of the core form assembly of FIG. 21, illustrating movement of an actuator for moving the core form assembly to a collapsed position to enable the core form assembly to be withdrawn from the core of a concrete member.
Figure 26:
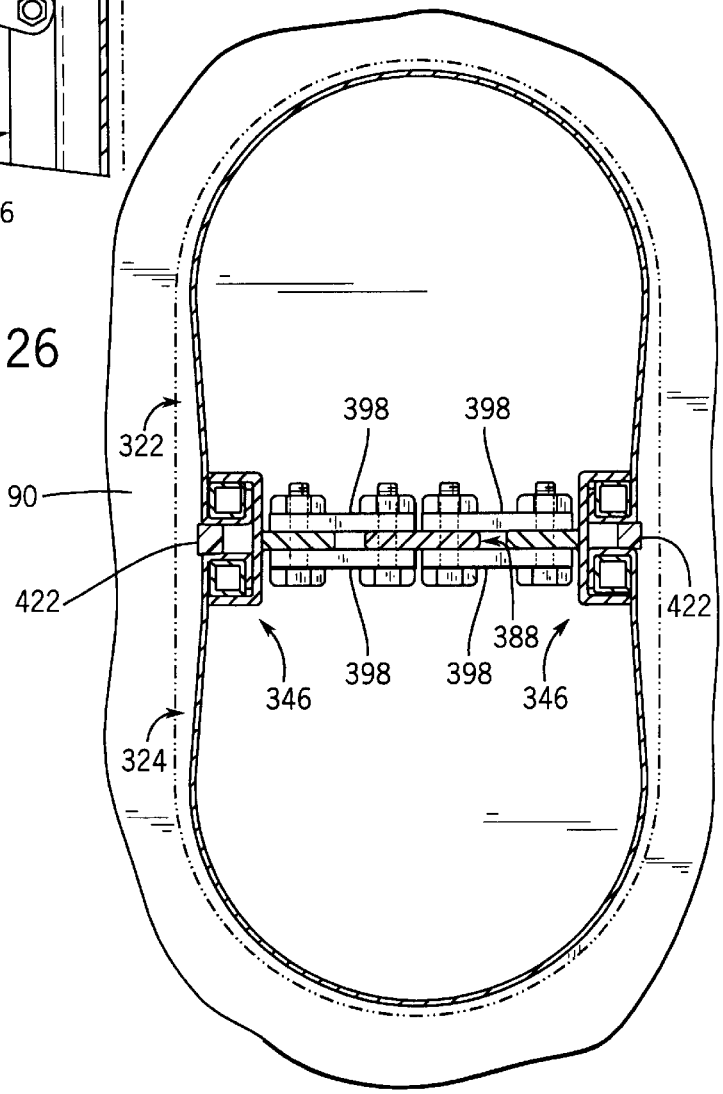
FIG. 26 is a view similar to FIG. 23, showing the core form assembly in its collapsed position when the core form assembly actuator is in its position of FIG. 25.

Core form assembly 104 is positioned on bottom forming member 90 in its position as shown in FIG. 1, wherein the outer surface of each of wall sections 322, 324 defines a forming surface having an outer cross-section corresponding to the desired final cross-section of a core 319 to be formed in a concrete member, such as a wall section or the like. Resilient filler material, such as a bead of caulk 422, is placed in the spaces between wall sections 322, 324. As shown in FIG. 24, caulk 422 engages the facing lips 338, 342 of wall sections 322, 324 so as to fully occupy the space therebetween. Any number of core form assemblies 104 can be employed to form a desired number of cores in the concrete member, by placing a desired number of bottom forming members, such as 90, each of which has a core form assembly 104 mounted thereon, and mounting the bottom forming members to form bed assembly 84. Once the core form assemblies 104 are placed in desired positions and the form assembly 44 is closed, concrete material is poured into the forming cavity 102 defined by the core form assembly to create a concrete member such as wall section 288 incorporating reinforcement structure. After the concrete material has been allowed to at least partially cure, each core form assembly 104 is moved to a collapsed position as shown in FIGS. 25 and 26, to draw the outer surfaces of wall sections 322, 324 away from the surfaces of the concrete material defining core 319. To collapse core form assembly 104, the user engages handle 320 within the handle passage defined by handle receiver 418, and exerts a force on handle 420 which causes rotation of handle assembly 404 about connector 416 in a counterclockwise direction. This movement of handle assembly 404 functions to rotate cam member 406 to a position as shown in FIG. 25, wherein cam surface 412 functions to place cam member end surface 408 into engagement with the upper surface of upper plate 378. This movement of cam member 406 functions to lift actuator member 388 upwardly from a first, lowered position as shown in FIG. 21 to a second, raised position as shown in FIG. 25. When actuator member 388 is in its raised position of FIG. 25, the inner end of each link 398 is moved upwardly relative to the outer end of each link 398, each of which is connected to retainer assembly bar 356. This movement of links 398 functions to draw retainer assemblies 346 inwardly toward each other, as shown in FIG. 26 to move straight, parallel wall portions 326, 328 of wall section 322 together toward each other, and to move straight, parallel wall portions 332, 334 of wall section 324 together toward each other. Bolts 362 and 384 are moved inwardly within slots 320, 380, respectively, to provide inward movement of the lower and upper ends of wall sections 322, 324.

Simultaneously, this inward movement of retainer assemblies 346 functions to draw curved wall sections 330, 336 inwardly toward each other as the straight, parallel wall portions 326, 328, and 332, 334 of wall sections 322, 324, respectively, are moved together. Inward movement of the lower ends of curved wall sections 330, 336 is accommodated by movement of bolts 376 within slots 377 formed in bottom plate 90,and inward movement of the upper ends of curved wall sections is accommodated by movement of bolts 384 within slots 382 formed in upper plate 378. When forming assembly 104 is in its collapsed position as shown in FIG. 26, handle 420 is removed from handle receiver 418 and the reinforced wall section, such as 288, can be lifted from between the side form assemblies such that core form assemblies 104 are allowed to move through each core 319 formed in the wall section defined by the core form assembly 104. Each core form assembly 104 is then returned to its forming position as shown in FIGS. 21 and 23, and the downward bias exerted by spring 396 on actuator member 388 functions to provide positive return of the various components of core form assembly 104 to reposition wall sections 322 in their forming position of FIG. 23.

When core form assembly 104 is moved to its collapsed position, the resilient bead of caulk 422 is compressed between the channel structure at the ends of wall sections 322, 324, to enable the wall section ends to be moved together. Caulk 422 returns to its uncompressed condition when wall sections 322, 324 are returned to their forming position. Caulk 422 can easily be removed from between wall sections 322, 324 and replaced as necessary during production.

As shown in FIG. 22, a number of core form assemblies can be placed adjacent each other and mounted to forming bed assembly 84. Each core form assembly 104 has its own bottom forming plate 90, and the ends of bottom forming plate 90 engage each other to form a continuous upwardly facing forming surface to define the bottom surface of wall section 288. As can be appreciated, forming bed assembly 84 and the manner in which each bottom forming plate 90 is mounted thereto via engagement of bolts 94 with connectors 96 in unstrung rails 98, provides quick and easy engagement and removal of each form assembly 104 to and from forming bed 84.

A bottom forming plate 90 constructed as illustrated in FIGS. 21–23 is provided for each core form assembly 104. In locations where cores are not desired in the wall section, a bottom forming plate 90 is employed which does not include a stud 100 or any of the slot structure associated with bottom forming plate 90 utilized with a core form assembly 104. Where a columnar reinforcement structure 256 is to be mounted, each bottom plate 90 includes a stud 100 for use in securing the columnar reinforcement structure 256 to the bottom plate 90 as shown and described previously.

Figure 27:
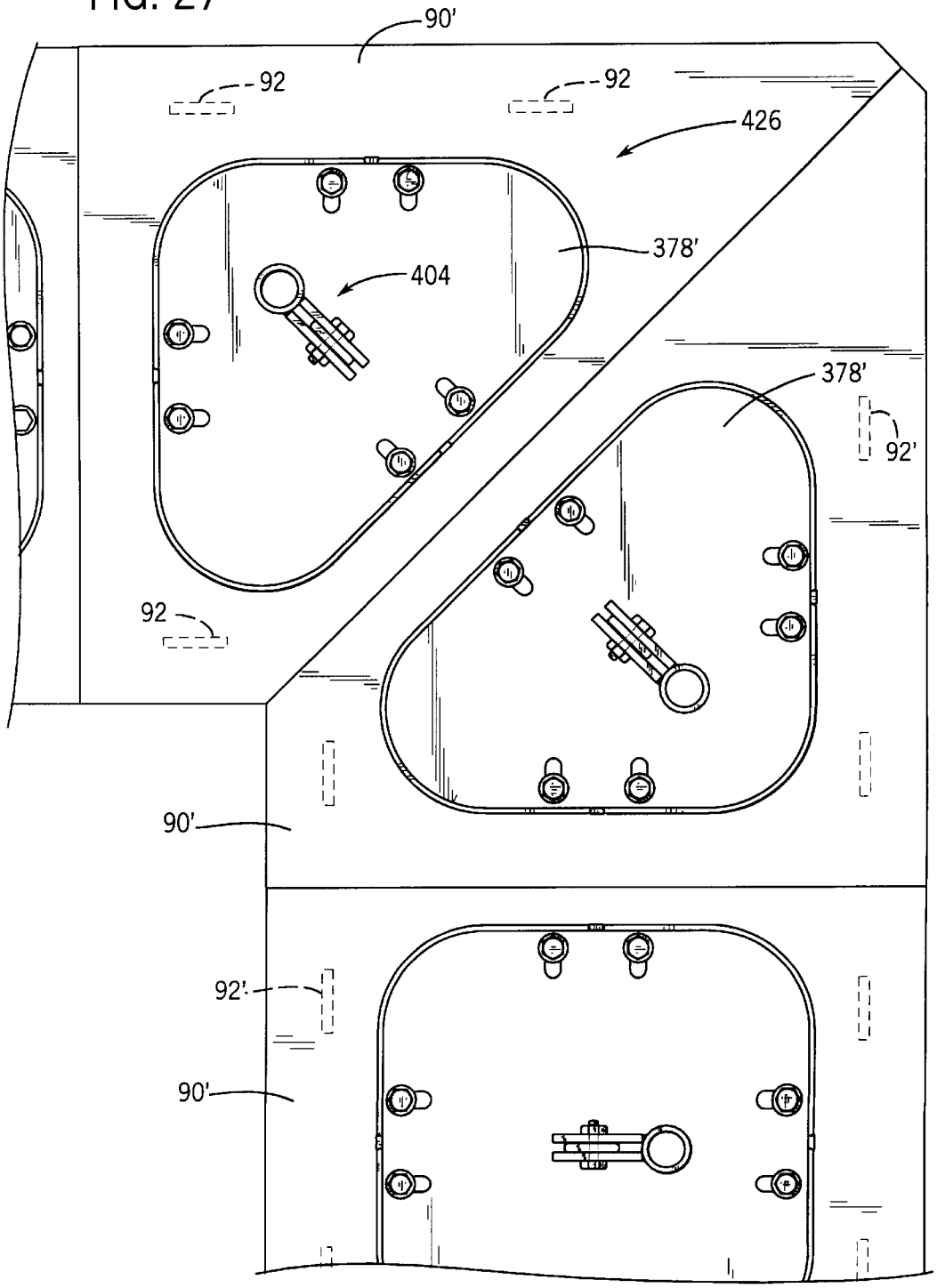
FIG. 27 is a top plan view illustrating a pair of three-sided core form assemblies as an alternative to the core form assembly constructed as illustrated in FIGS. 21–26.

FIGS. 27–29 illustrate an alternative core form assembly 426 configured so as to form a three-sided core in a concrete member such as a wall section and having a generally similar construction to that of core form assembly 104. As shown in FIG. 27, three-sided core form assembly 426 is preferably used when forming a wall having a right-angle comer, to form facing three-sided cores in the concrete material defining the comer. Core form assembly 426 has essentially the same construction as core form assembly 104, incorporating three wall sections instead of the two wall sections of core form assembly 104, with the wall sections having a shape when in a forming position corresponding to the desired core shape. Three retainer assemblies 346 are employed to interconnect the channel structure at adjacent ends of the wall sections, as shown and described with respect to FIGS. 23 and 24. In this embodiment, the actuator member, shown at 428, is in the form of an angle member defining a pair of right-angle flanges 430, 432, with a third flange 434 mounted at the junction of flanges 430, 432 and bisecting the angle defined therebetween. Mounting strips 436, 438 are secured to flanges 430, 432, respectively, adjacent the outer end of each flange. Links 398 are pivotably mounted to each mounting strip 436, 438, to intermediate flange 434, and to each retainer assembly 346, as shown and described previously. Actuator member 428 is interconnected with a handle assembly 404 as shown and described previously, such that vertical movement of actuator member 428 under the operation of handle assembly 404 functions to move actuator member 428 upwardly and downwardly relative to the wall sections of core form assembly 426. As described with respect to core form assembly 104, this movement of actuator member 428 functions to move the wall sections of wall core form assembly 426 through links 398 between a forming position as shown in FIG. 28 and a collapsed position as shown in FIG. 29.

Figure 30:
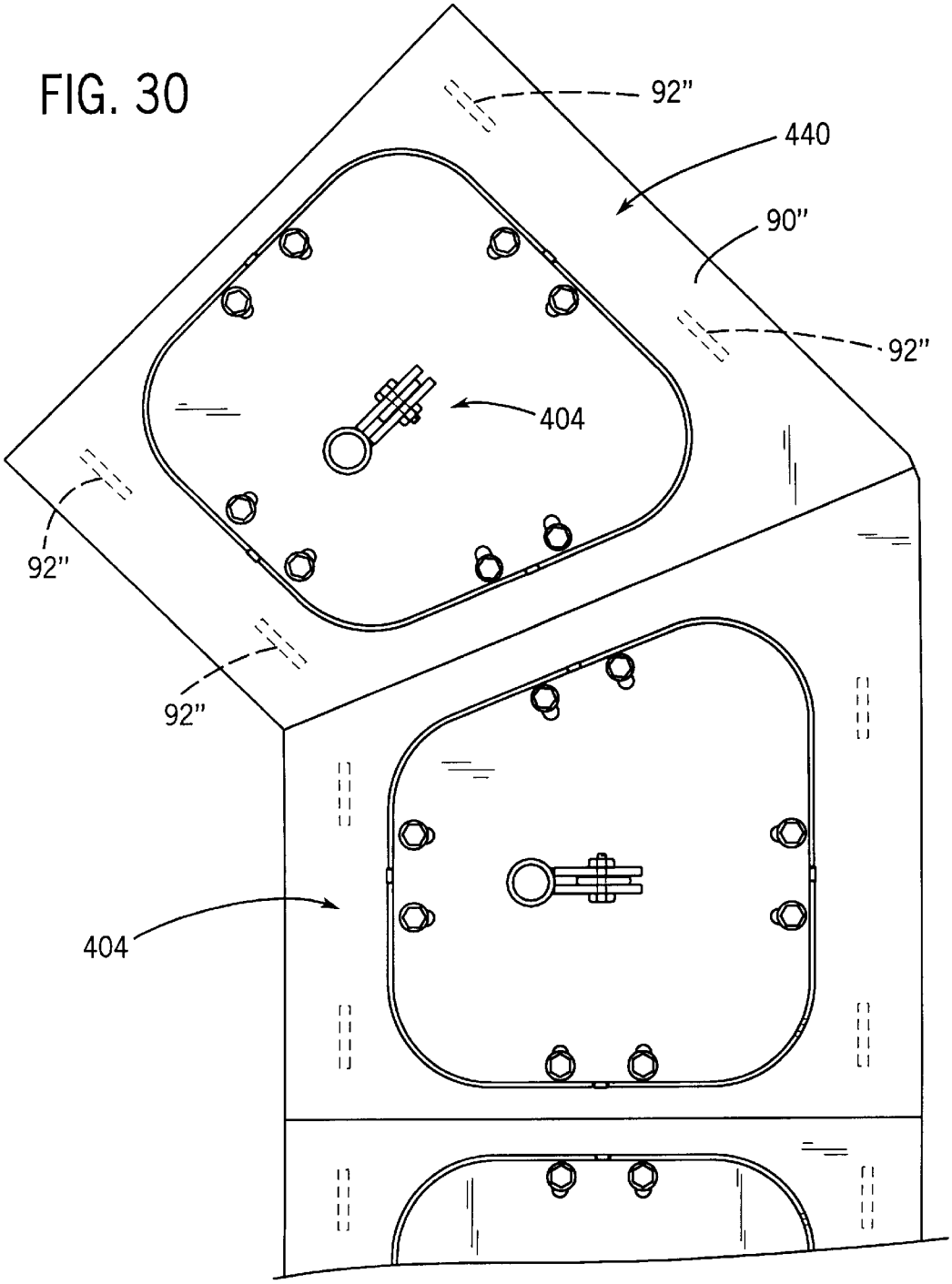
FIG. 30 is a view similar to FIG. 27, illustrating a four-sided core form assembly for use in forming a core in a concrete member, and illustrating a number of such core form assemblies ganged together.
Figure 32:
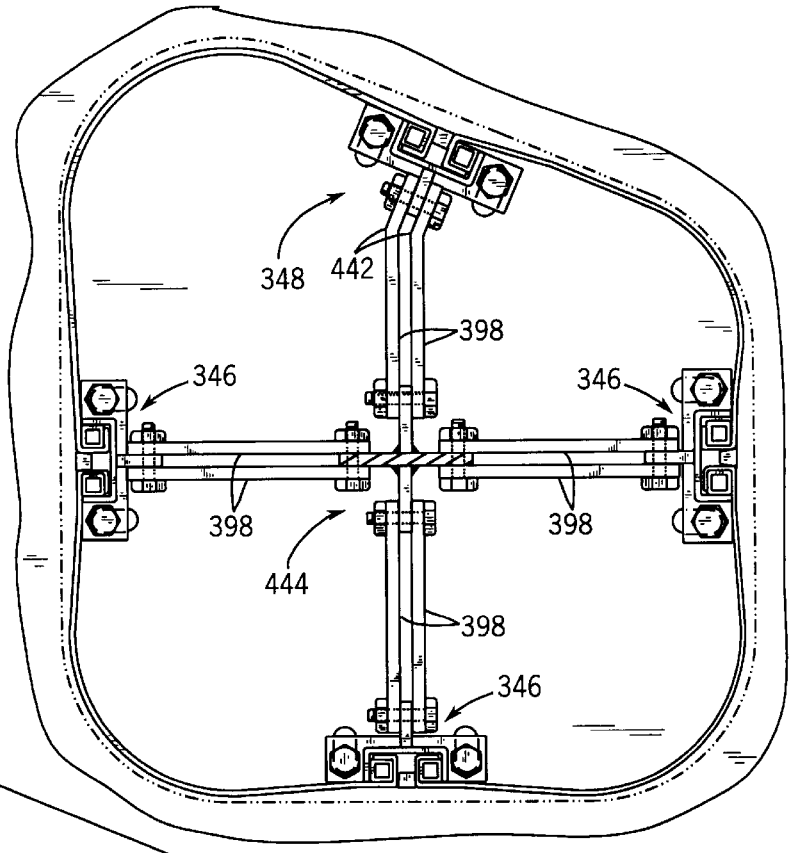
FIG. 32 is a view similar to FIG. 31, showing the core form assembly in its collapsed position.
Figure 31:
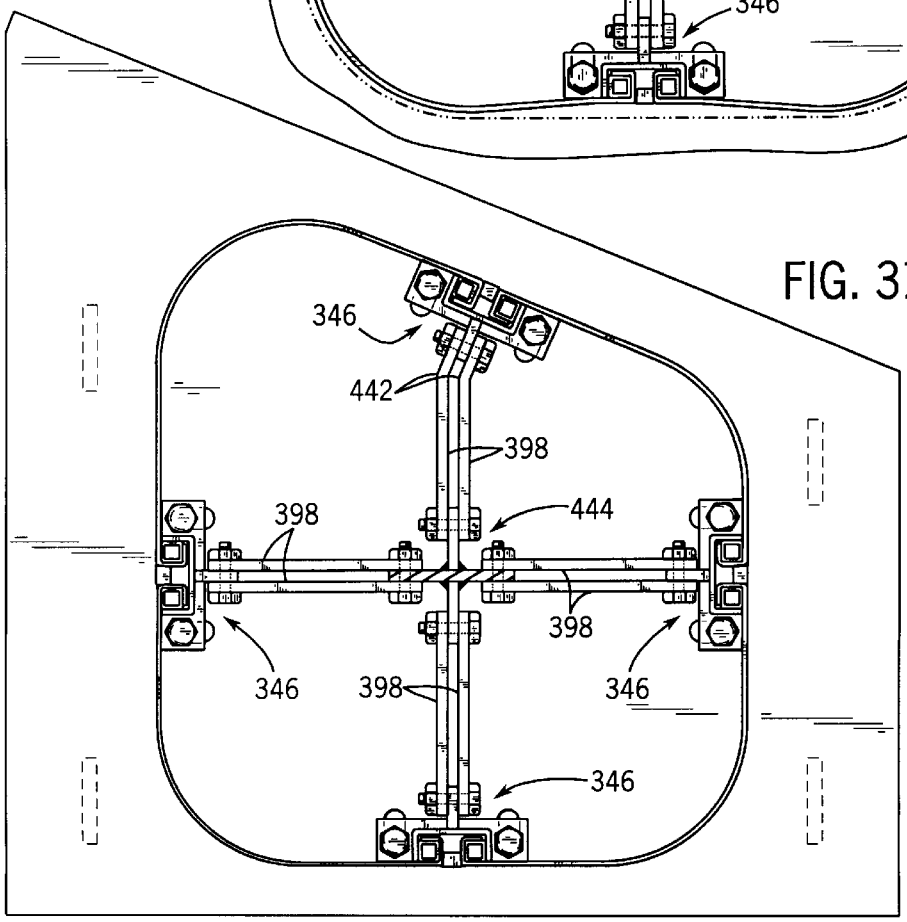
FIG. 31 is a view similar to FIG. 28, showing the core form assembly of FIG. 30 in its forming position.

FIGS. 30–32 show yet another alternative core form assembly 440 for forming a trapezoidal core in a concrete member such as a wall section, having a generally similar construction as core form assembly 104. Core form assembly 440 is adapted for forming a core at a nonperpendicular corner in the wall section. Each core form assembly 440 is constructed and operates similarly to core form assemblies 104 and 426. In this embodiment, one of the sets of link members 398 is formed with a bend, shown at 442. The actuator member, shown at 444, includes four mounting sections disposed at right angles to each other, with sets of link members 398 pivotably connected to each mounting section at one end and pivotably connected at the other end to one of retainer assemblies 346. A handle assembly 404 is mounted to actuator member 444 for moving actuator member 444 upwardly and downwardly relative to the core form wall sections. As discussed previously, upward movement of actuator member 444 functions to draw retainer members 346 inwardly toward each other to move the core form assembly wall sections to a collapsed position as shown in FIG. 32, and a spring such as 396 is interconnected with the lower end of actuator member 444 for biasing actuator member 444 downwardly to a position in which the wall sections of core form assembly 426 are in a forming position.

Figure 33:
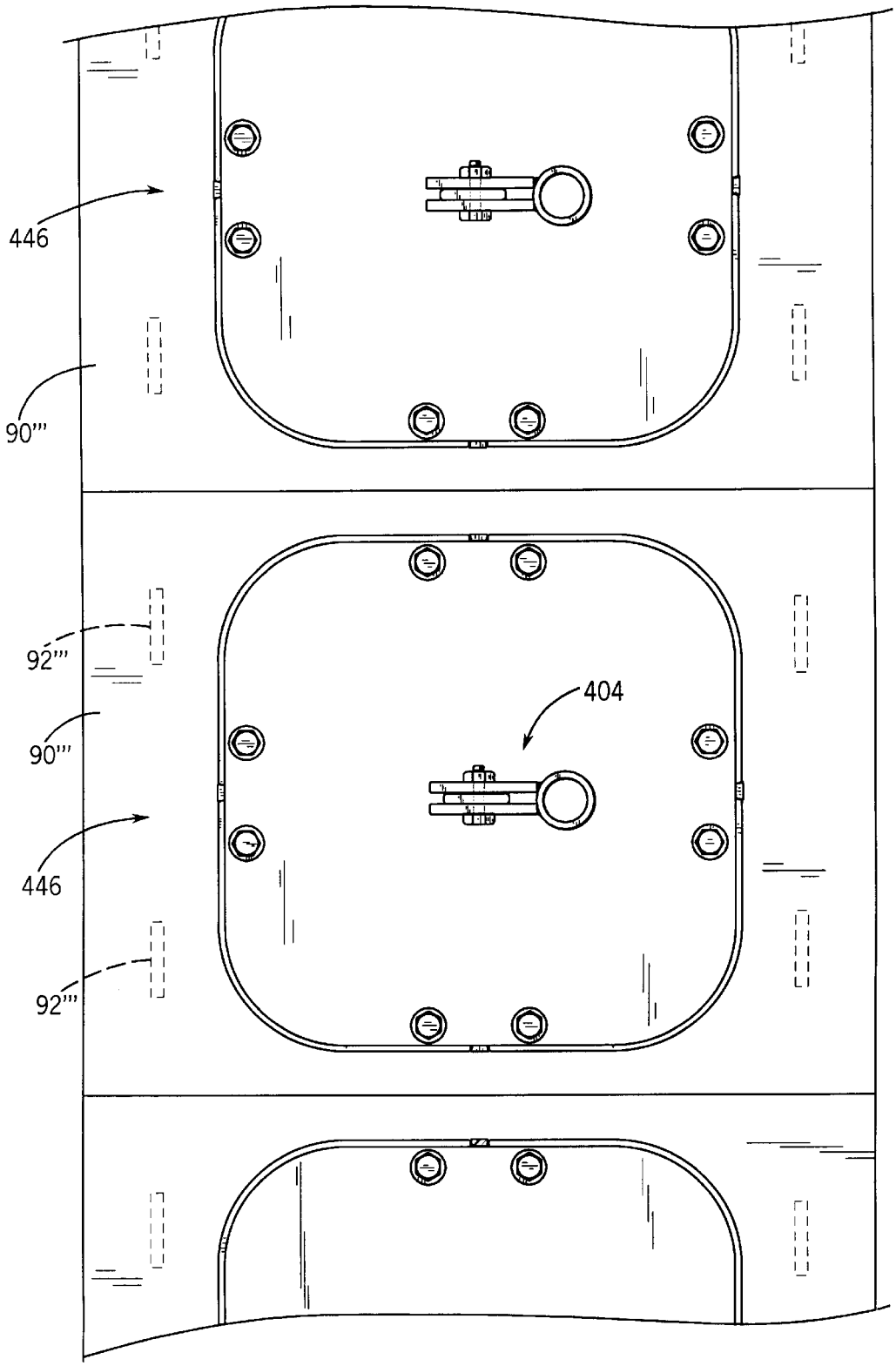
FIG. 33 is a top plan view showing an alternative construction of a four-sided core form assembly for use in forming a core in a concrete member, and illustrating a number of such core of assemblies ganged together.
Figure 34:
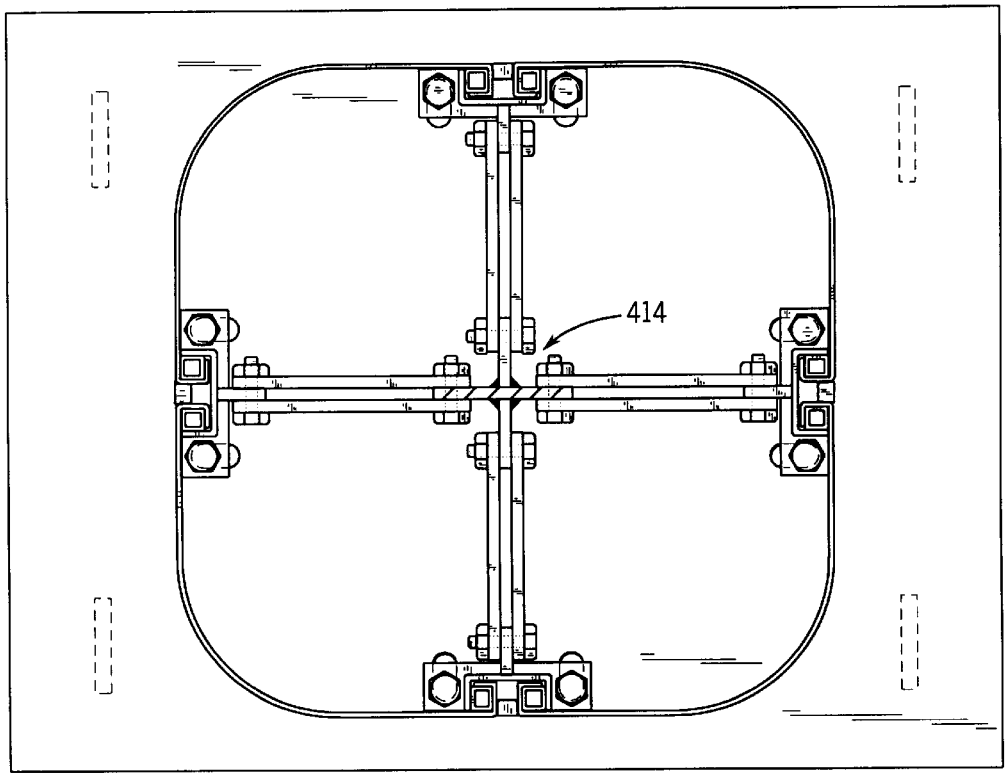
FIG. 34 is a partial section view of the core form assembly of FIG. 33, illustrating the core form assembly in a forming position.
Figure 35:
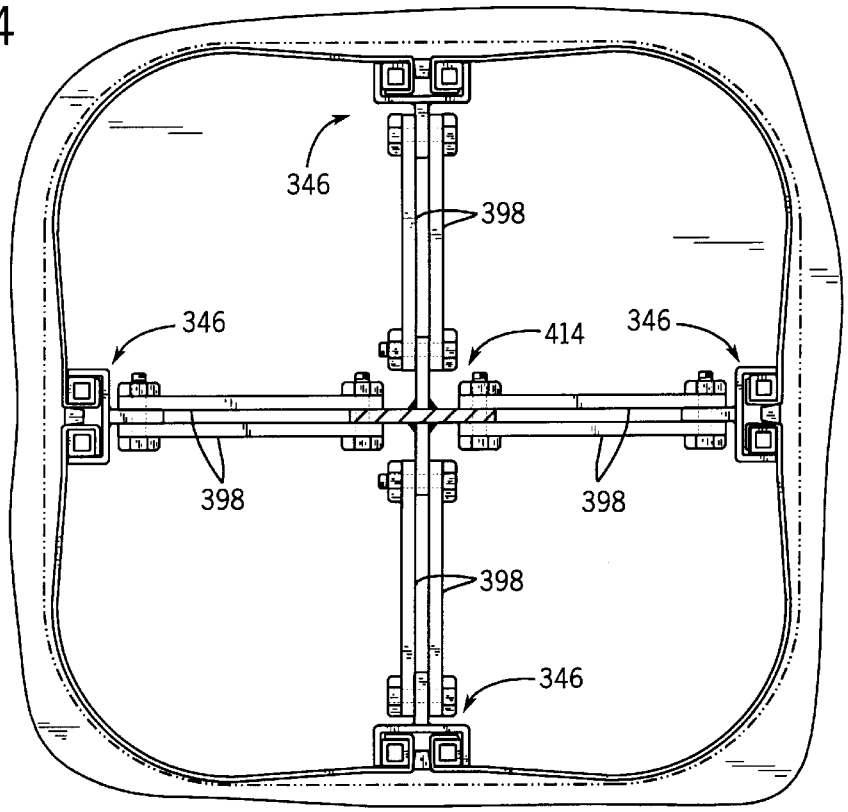
FIG. 35 is a view similar to FIG. 34, showing the core form assembly in its collapsed position.

FIGS. 33–35 illustrate another embodiment of a core form assembly, shown at 448, again having a construction generally similar to core form assembly 104. Core form assembly 448 is constructed similarly to core form assembly 426, except being configured such that each side of the core formed by core form assembly 428 is substantially parallel to an opposite side of the core. Core form assembly 428 is employed when forming relatively large cores, such as in an exterior wall section, whereas core form assembly 104 is well suited for forming cores in interior wall sections.

The cores formed by the core form assemblies are preferably filled with an insulating material. The insulating material in the exterior wall section cores functions to provide heat insulation, while the insulating material in the interior wall section cores primarily provides acoustic insulation.

It can thus be appreciated that the invention provides a system for efficiently constructing building components such as wall and floor sections on-site in an efficient manner utilizing a relatively small number of workers. The form assembly can be configured to form building components having any desired shape, and the core form assemblies and the columnar reinforcement structures can be placed in any desired position within the wall section in such a manner as to provide quick and simple wall construction and removal of the wall section from the form.

Various alternatives and embodiments are contemplated as being within the scope of the following claims particularly pointing out and distinctly claiming the subject matter regarded as the invention.

I claim:

1. A system for casting a concrete member, comprising:

a pair of spaced form members defining first and second spaced side form surfaces;

an end member defining an end form surface extending between the first and second spaced side form surfaces; and at least one core form assembly mounted to the end member and disposed between the first and second spaced side form surfaces, wherein the core form assembly defines a core form surface and includes a collapsing arrangement for moving the core form assembly from a forming position in which the core form surface functions to define a core when concrete material is placed between the first and second spaced side form surfaces, and a collapsed position in which the core form surface is moved away from the concrete material defining the core to provide withdrawal of the core form assembly through the core.

2. The system of claim 1, wherein the core form assembly defines an upper end and a lower end, wherein the lower end of the core form assembly is mounted to the end member, and further comprising a top member to which the upper end of the core form assembly is mounted, and wherein the core form assembly is movably mounted to both the end member and the top member for accommodating movement of the core form assembly between the forming position and the collapsed position.

3. The system of claim 2, wherein the core form assembly is mounted to each of the end member and the top member via at least one fastener extending therebetween, and wherein the movable mounting of the core form assembly to the end member and the top member is provided by movement of each fastener within slot structure formed in the end member and in the top member.

4. The system of claim 1, wherein the core form assembly includes an actuator for moving the core form assembly between the forming position and the retracted position, and wherein the actuator is interconnected with the end member.

5. The system of claim 4, wherein the core form assembly defines an upper end and a lower end, wherein the lower end of the core form assembly is mounted to the end member, and further comprising a top member to which the upper end of the core form assembly is mounted, wherein the actuator includes a handle interconnected with a cam member operable on the actuator and engageable with the top member for moving the actuator between a first position in which the core form assembly is in the forming position and a second position, in which the core form assembly is moved to the retracted position.

6. The system of claim 5, wherein the actuator includes an actuator rod movable between the first and second positions in response to operation of the handle and cam member, and further comprising a spring interposed between the actuator rod and the core form assembly for biasing the actuator rod toward the first position.

7. A core form assembly for placement between a pair of spaced form surfaces for forming a core in concrete material placed between the spaced form surfaces, comprising:

peripheral wall structure defining a core form surface;

a collapsing arrangement for moving the peripheral wall structure from a forming position in which the core form surface functions to create a core in concrete material placed between the pair of spaced form surfaces, and a collapsed position in which the core form surface is moved away from the concrete material defining the core;

a biasing arrangement for urging the peripheral wall structure toward its forming position; and an actuator assembly for moving the peripheral wall structure to the collapsed position against the force of the biasing arrangement;

wherein the core form assembly includes first and second end members to which the peripheral wall structure is mounted for movement between the forming position and the collapsed position.

8. The core form assembly of claim 7, wherein the peripheral wall structure is interconnected with each of the first and second end members via at least one fastener extending therebetween, and wherein the peripheral wall structure is movable relative to each end member by means of a slot formed in each end member through which the at least one fastener extends.

9. The core form assembly of claim 7, wherein the actuator assembly includes a movable actuator member disposed within a passage defined by the peripheral wall structure, and an actuator handle interconnected with the actuator member and operable on the first end member for moving the actuator member between a first position in which the peripheral wall structure is in the forming position and a second position in which the peripheral wall structure is in the collapsed position.

10. The core form assembly of claim 9, wherein the biasing arrangement comprises a spring interposed between the actuator member and the second end member for urging the actuator member toward the first position.

11. The core form assembly of claim 9, wherein the actuator member comprises an axially extending rod defining a first end with which the actuator handle is interconnected and a second end with which the biasing arrangement is interconnected, and wherein the rod is interconnected with the peripheral wall structure by means of at least one pair of link members pivotably mounted to the rod and to the peripheral wall structure, wherein the link members function to move the peripheral wall structure from the forming position to the collapsed position upon axial movement of the rod from the first position to the second position.

12. A core form assembly for placement between a pair of spaced form surfaces for forming a core in concrete material placed between the spaced form surfaces, comprising:

peripheral wall structure defining a core form surface;

a collapsing arrangement for moving the peripheral wall structure from a forming position in which the core form surface functions to create a core in concrete material placed between the pair of spaced form surfaces, and a collapsed position in which the core form surface is moved away from the concrete material defining the core;

a biasing arrangement for urging the peripheral wall structure toward its forming position; and an actuator assembly for moving the peripheral wall structure to the collapsed position against the force of the biasing arrangement;

wherein the peripheral wall structure defines a pair of spaced, facing end sections defining a space therebetween, and further includes a resilient filler disposed within the space between the spaced, facing end sections, wherein the resilient filler is compressed between the spaced, facing end sections as the peripheral wall structure is moved to the collapsed position from the forming position.

13. A core form assembly for placement between a pair of spaced form surfaces for forming a core in concrete material placed between the spaced form surfaces comprising:

wall structure defining an outer core-forming surface and including a pair of spaced, facing end sections defining a space therebetween;

a resilient filler disposed within the space between the spaced, facing end sections; and a collapsing arrangement interconnected with the wall structure for moving the wall structure between a forming position and a collapsed position in which the outer core-forming surface is moved inwardly away from the concrete material defining the core, wherein the resilient filler is compressed between the spaced, facing end sections to enable movement of the wall structure to the collapsed position;

wherein the spaced, facing end sections of the wall structure define a pair of lips which extend inwardly from the outer core-forming surface of the wall structure, and wherein the resilient filler is interposed between the lips.

14. The core form assembly of claim 13, wherein the collapsing arrangement is interconnected with the pair of lips.

15. The core form assembly of claim 13, further comprising first and second end members to which the wall structure is mounted for movement between the forming position and the collapsed position.

16. The core form assembly of claim 15, wherein the collapsing arrangement comprises a retainer interconnected with the spaced, facing end sections of the wall structure, and a movable actuator interconnected with the retainer for moving the retainer between an inward position in which the wall structure is in the collapsed position and an outward position in which the wall structure is in the forming position.

17. The core form assembly of claim 16, wherein the spaced, facing end sections of the wall structure each define a channel configuration and wherein the retainer includes a pair of spaced engagement members, each of which is received within one of the end section channel configurations.

18. The core form assembly of claim 13, wherein the resilient filler comprises caulk material placed between the lips.

19. A core form assembly for placement between a pair of spaced form surfaces for forming a core in concrete material placed between the spaced form surfaces, comprising:

outer wall structure including at least first and second wall members, each of which defines an outer core-forming surface, wherein the first wall member includes a first inwardly extending lip and the second wall member includes a second inwardly extending lip, wherein the first and second lips are located adjacent each other;

a retainer member interconnected with the first and second lips; and an actuator interconnected with the retainer for moving the retainer inwardly to move the outer core-forming surfaces of the first and second wall members inwardly from a forming position to a collapsed position away from concrete material defining the core.

20. The core form assembly of claim 19, wherein each lip comprises a portion of channel structure defined by each of the first and second wall members, and wherein the retainer member includes engagement structure received within each of the channel structures to interconnect the retainer member with the first and second lips.

21. The core form assembly of claim 19, further comprising first and second end members to which each retainer member is movably mounted for movement between an outward position in which the first and second wall members are placed in the forming position in an inward position in which the first and second wall members are placed in the collapsed position.

22. The core form assembly of claim 21, wherein each retainer member is interconnected with at least one of the first and second end members via a fastener extending through slot structure formed in the end member, wherein movement of the fastener within the slot structure accommodates movement of the retainer member between the inward and outward positions.

23. The cot form assembly of claim 21, wherein the actuator includes an actuator member extending into a passage defined by the first and second wall members and an actuator handle including cam structure engageable with one of the first and second end members for moving the actuator member relative to the retainer members, and wherein the actuator member is interconnected with each retainer member for moving each retainer member between the inward and outward positions upon movement of the actuator member relative to the first and second wall members.

24. The core form assembly of claim 23, further comprising a biasing arrangement interconnected with the actuator member and the other of the first and second end members for urging the actuator member toward a position in which each retainer member is in the outward position.

25. A core form assembly for placement between a pair of spaced form surfaces for forming an axially-extending core in concrete material placed between the spaced form surfaces, comprising:

wall structure defining an outer core-forming surface; and a collapsing arrangement interconnected with the wall structure for moving the wall structure between a forming position and a collapsed position in which the outer core-forming surface is moved inwardly away from concrete material defining the core, the collapsing arrangement including a pair of retainers interconnected with the wall structure at spaced locations, an actuator member disposed between the pair of spaced retainers and being movable in a direction parallel to the longitudinal axis of the core, and one or more links interconnected between the actuator member and each retainer for causing inward movement of the retainers upon movement of the actuator member to move the wall structure from the forming position to the collapsed position;

first and second end members to which the pair of retainers are movably mounted between an inward position in which the wall structure is in the collapsed position and an outward position in which the wall structure is in the forming position;

wherein each retainer member is mounted to at least one of the first and second end members by means of a fastener extending through a slot formed in the end member, wherein movement of the fastener within the slot accommodates movement of the retainer member between the inward and outward positions.

26. A core form assembly for placement between a pair of spaced form surfaces for forming an axially-extending core in concrete material placed between the spaced form surfaces, comprising:

wall structure defining an outer core-forming surface; and a collapsing arrangement interconnected with the wall structure for moving the wall structure between a forming position and a collapsed position in which the outer core-forming surface is moved inwardly away from concrete material defining the core, wherein the collapsing arrangement includes:

a pair of retainers interconnected with the wall structure at spaced locations;

an actuator member disposed between the pair of spaced retainers and being movable in a direction parallel to the longitudinal axis of the core;

one or more links interconnected between the actuator member and each retainer for causing inward movement of the retainers upon movement of the actuator member to move the wall structure from the forming position to the collapsed position;

first and second end members to which the pair of retainers are movably mounted between an inward position in which the wall structure is in the collapsed position and an outward position in which the wall structure is in the forming position;

an actuator handle interconnected with the actuator member for imparting movement to the actuator member, wherein the actuator handle includes cam structure engageable with the first end member.

27. The core form assembly of claim 26, further comprising a spring interposed between the actuator member and the second end member for urging the actuator member toward a position in which the retainers are placed in the outward position.

28. A core form assembly for placement between a pair of spaced form surfaces for forming an axially-extending core in concrete material placed between the spaced form surfaces, comprising:

wall structure defining an outer core-forming surface; and a collapsing arrangement interconnected with the wall structure for moving the wall structure between a forming position and a collapsed position in which the outer core-forming surface is moved inwardly away from concrete material defining the core, the collapsing arrangement including a pair of retainers interconnected with the wall structure at spaced locations, an actuator member disposed between the pair of spaced retainers and being movable in a direction parallel to the longitudinal axis of the core, and one or more links interconnected between the actuator member and each retainer for causing inward movement of the retainers upon movement of the actuator member to move the wall structure from the forming position to the collapsed position;

wherein the wall structure includes spaced, facing end sections in a pair of spaced locations, wherein each retainer is interconnected with one of the pairs of spaced, facing end sections, and further comprising a resilient filler disposed between each pair of spaced, facing end sections which is compressed therebetween as the wall structure is moved from the forming position to the collapsed position.

29. The core form assembly of claim 28, wherein each spaced, facing end section comprises channel structure and wherein each retainer includes an engagement member received within the channel structure for interconnecting the retainer with the wall structure.

30. The core form assembly of claim 28, further comprising first and second end members to which the pair of retainers are movably mounted between an inward position in which the wall structure is in its collapsed position and an outward position in which the wall structure is in its forming position.

31. A core form assembly for casting a core in a concrete member including a pair of spaced form members defining first and second spaced form surfaces, comprising:

wall structure defining an outer core-forming surface;

a collapsing arrangement for moving the wall structure from an outward forming position to an inward collapsed position in which the outer core-forming surface is moved inwardly away from concrete material defining the core; and a pair of end members between which the wall structure extends, wherein each end member is interconnected with the wall structure via a plurality of fasteners and wherein each end member includes slot structure through which each fastener extends and is movable therewithin to provide movement of the wall structure relative to the end members between the forming position and the collapsed position.

32. The core form assembly of claim 31, wherein the collapsing arrangement includes an actuator including an actuator member located within a passage defined by the wall structure and an actuator handle for moving the actuator member, wherein the actuator member is interconnected with the wall structure such that movement of the actuator member causes movement of the wall structure between the forming and collapsed positions.

33. The core form assembly of claim 32, wherein the actuator handle includes cam structure engageable with a first one of the end members and wherein the actuator member is movable relative to the end members such that engagement of the actuator handle cam structure with the first end member causes movement of the actuator member relative to the end members.

34. The core form assembly of claim 33, wherein the actuator member is interconnected with the wall structure via a pair of spaced retainers engaged with the wall structure at spaced locations, wherein the actuator member is interconnected with the spaced retainers such that movement of the actuator member causes movement of the spaced retainers between an inward position in which the wall structure is in the collapsed position and an outward position in which the wall structure is in the forming position.

35. The core form assembly of claim 34, wherein the fasteners are engaged with the retainers for accommodating movement of the retainers between the inward position and the outward position.

36. The core form assembly of claim 34, further comprising a spring interconnected between the actuator member and a second one of the end members for biasing the actuator member toward a position in which the retainers are in the outward position.

* * * * *

UNITED STATES PATENT AND TRADEMARK OFFICE

CERTIFICATE OF CORRECTION

PATENT NO. : 6,082,059
DATED : July 4, 2000
INVENTOR(S) : DAVID C. LOOMANS

It is certified that error appears in the above-identified patent and that said Letters Patent is hereby corrected as shown below:

CLAIM 5, column 24, line 57, after "position" delete -- , --; CLAIM 25, column 27, line 60, after "retainer" delete "member; CLAIM 25, column 27, line 64, after "retainer" delete "member".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*